United States Patent [19]

Durkee

[11] 4,148,019

[45] Apr. 3, 1979

[54] SECURITY ALARM TRANSMISSION SYSTEM

[75] Inventor: John E. Durkee, Ft. Atkinson, Wis.

[73] Assignee: Thomas Industries Inc., Ft. Atkinson, Wis.

[21] Appl. No.: 555,550

[22] Filed: Mar. 5, 1975

[51] Int. Cl.[2] ..... G08B 19/00

[52] U.S. Cl. ..... 340/531; 179/82; 340/521; 340/545; 340/584; 340/693

[58] Field of Search ..... 340/531, 532, 539, 521, 340/545, 584, 693; 179/82; 325/185, 494, 492

[56] References Cited

U.S. PATENT DOCUMENTS

| | | | |
|---|---|---|---|
| 2,419,833 | 4/1947 | Grimes | 179/82 |
| 3,043,916 | 10/1962 | Sneath | 179/82 |
| 3,113,270 | 12/1963 | Bassett | 179/82 |
| 3,195,540 | 7/1965 | Waller | 325/185 |
| 3,449,738 | 6/1969 | Chesnul et al. | 340/274 R |
| 3,487,404 | 12/1969 | Midkiff | 340/420 |
| 3,582,921 | 6/1971 | Krieger | 340/189 M |
| 3,713,124 | 1/1973 | Durland | 340/189 M |
| 3,760,359 | 9/1973 | McQuown | 340/416 |
| 3,792,455 | 2/1974 | Phillips | 340/224 |
| 3,797,008 | 3/1974 | Yuasa | 340/409 |
| 3,833,895 | 9/1974 | Fecteau | 340/224 |
| 3,840,868 | 10/1974 | Campman | 340/420 |
| 3,852,740 | 12/1974 | Haymes | 340/224 |
| 3,973,250 | 8/1976 | Uffelman | 340/274 R |
| 3,978,469 | 8/1976 | Schaad | 340/416 |

OTHER PUBLICATIONS

EXAR Integrated Sys. Inc., "Monolithic Phase--Locked Loop", XR215, Jul. 1972.

*Primary Examiner*—Glen R. Swann, III

*Attorney, Agent, or Firm*—Emrich, Root, O'Keeffe & Lee

[57] ABSTRACT

A security alarm transmission system for protecting a building includes a plurality of alarm transmitter units each having a transmitter circuit controlled by associated condition sensors to generate coded alarm signals which are inductively coupled to a pick-up loop extending around the periphery of the building and extended to a receiver connected to the loop which decodes the alarm signals and provides a suitable alarm indication. The alarm transmitter unit is adaptable to provide different alarm outputs for indicating fire in the building or an unauthorized entry of the building, or an emergency condition, for example. The multipurpose alarm transmitter unit comprises a housing unit for containing the transmitter circuit, the housing permitting the transmitter circuit to be controlled by normally open or normally closed switches, and a mounting assembly which permits convenient installation of the transmitter unit at desired locations.

16 Claims, 26 Drawing Figures

CHARGE CIRCUIT IN TRANSMITTER UNIT

CHARGE CIRCUIT IN TRANSMITTER UNIT

TRANSMITTER FOR UNITS WITH NORMALLY CLOSED SENSOR CONTACTS

FOUR POSITION KEY SWITCH
SERVICE
EMER CANCEL
BURG. OFF
BURG ON SW'D.
CONTROL PANEL HORN
OUTSIDE ALARM CONTROL MOD.
DELAY'D DIAL ACT. MOD.
LOOP MONITOR
EMER MOD
FIRE MOD
T.L.C. & PULSE MOD
BURG. TONE & ENTRY MOD
POWER SUPPLY MOD
RF MOD
LOOP
CONTROL PANEL 119
DAY
NITE
DIN
EXIT
TIR
FIRE
EMER
CANCEL
OFF
ON
SERVICE
120 VAC
16VAC hi B+
lo B+
TONE OUTPUT
TROUBLE SIGNAL OUTPUT
PHASE LOCK LOOP
RF MODULE 110
LOOP MONITOR
INPUT FROM LOOP 28
FIRE TONE DETECTOR MODULE 120
FIRE TONE DECODER
TO FIRE DIALER
FIRE SIGNAL OUTPUT TO HORN
TEST/RESET SWITCH
Hi B+
LO B+

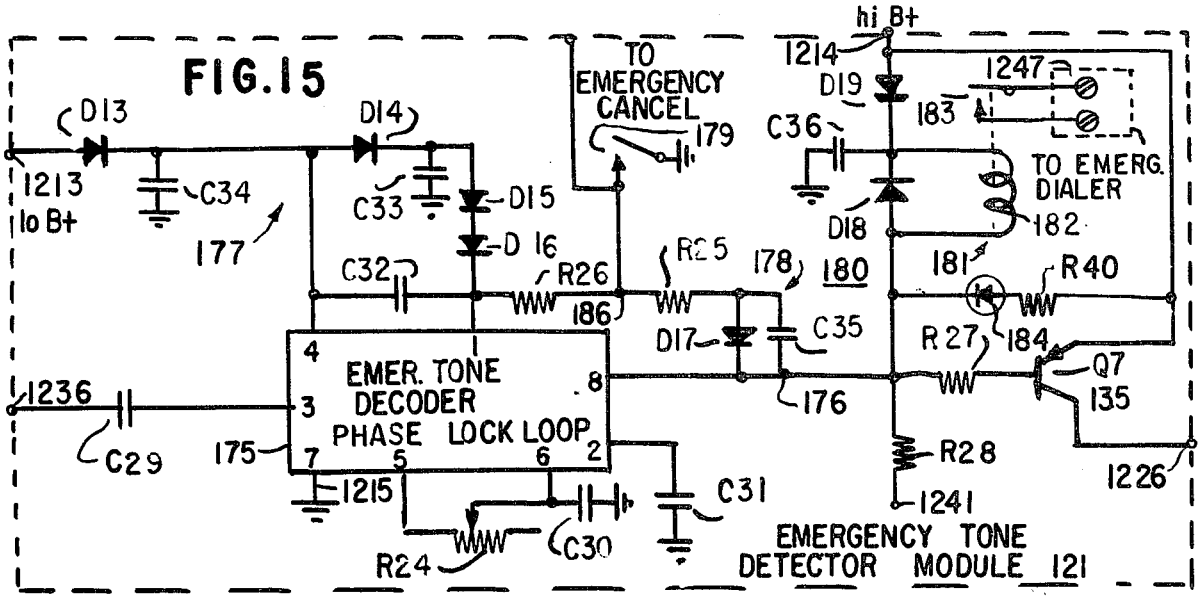
FIG. 15
hi B+
TO EMERGENCY CANCEL
179
1214
D19
1247
183
C36
TO EMERG. DIALER
D13
D14
1213
lo B+
C34
C33
D15
D16
177
D18
182
C32
R26
R25
178
180
181
R40
186
D17
C35
R27
184
Q7
135
1236
EMER. TONE DECODER PHASE LOCK LOOP
176
C29
175
1215
C31
R28
1226
1241
R24
C30
EMERGENCY TONE DETECTOR MODULE 121

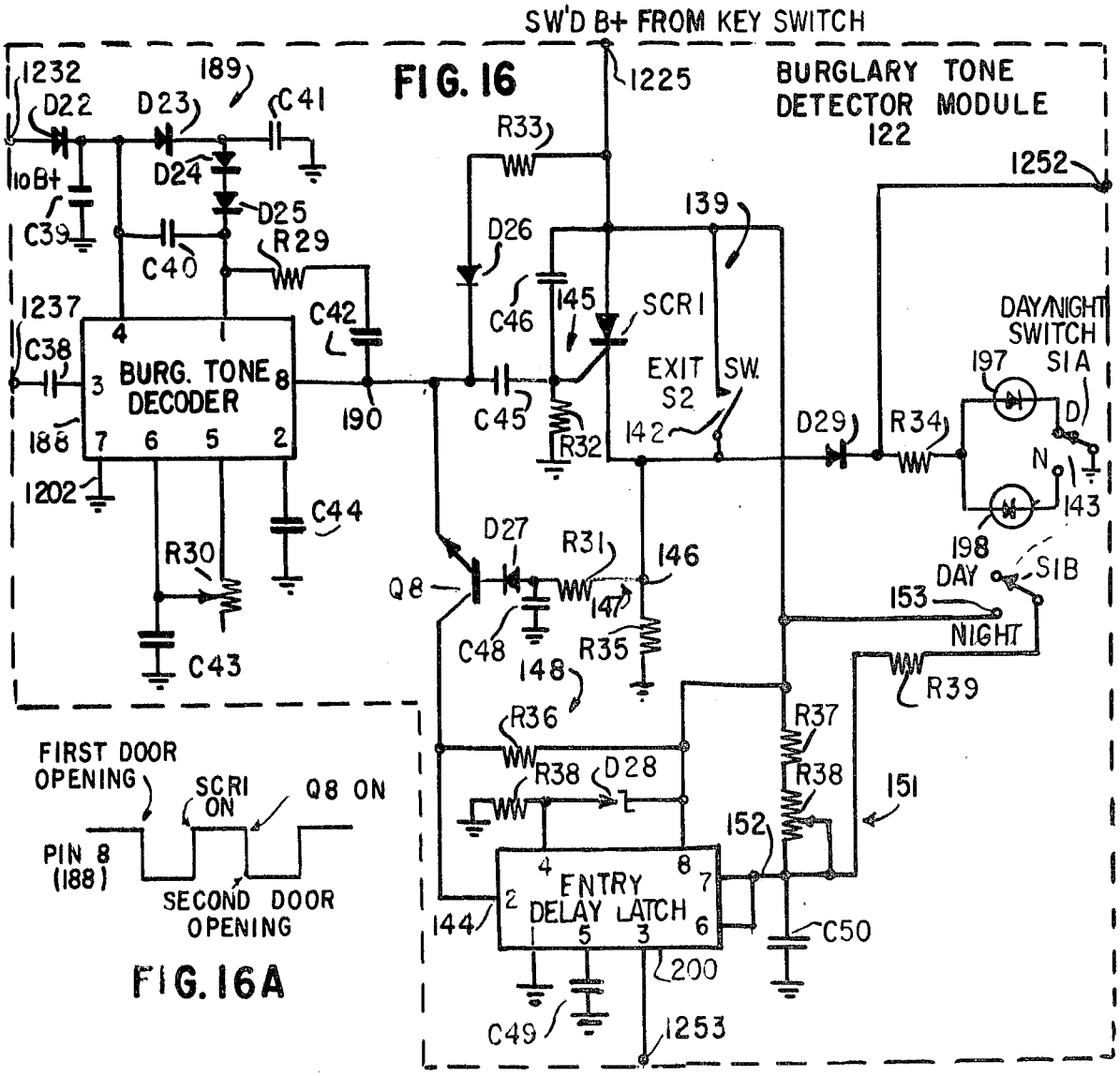
SW'D B+ FROM KEY SWITCH
FIG. 16
1225
BURGLARY TONE DETECTOR MODULE 122
1232
189
D22
D23
C41
R33
1252
lo B+
D24
D25
139
C39
C40
R29
D26
1237
C42
C46
145
SCR1
DAY/NIGHT SWITCH
C38
BURG. TONE DECODER
EXIT S2
SW.
197
S1A
188
190
C45
R32
142
D29
R34
D
N
1202
C44
143
198
D27
R31
146
R30
Q8
147
DAY
S1B
153
C48
R35
NIGHT
C43
148
R39
R36
R37
FIRST DOOR OPENING
SCR1 ON
Q8 ON
R38
D28
R38
151
PIN 8 (188)
152
ENTRY DELAY LATCH
SECOND DOOR OPENING
144
C50
200
C49
1253
FIG. 16A

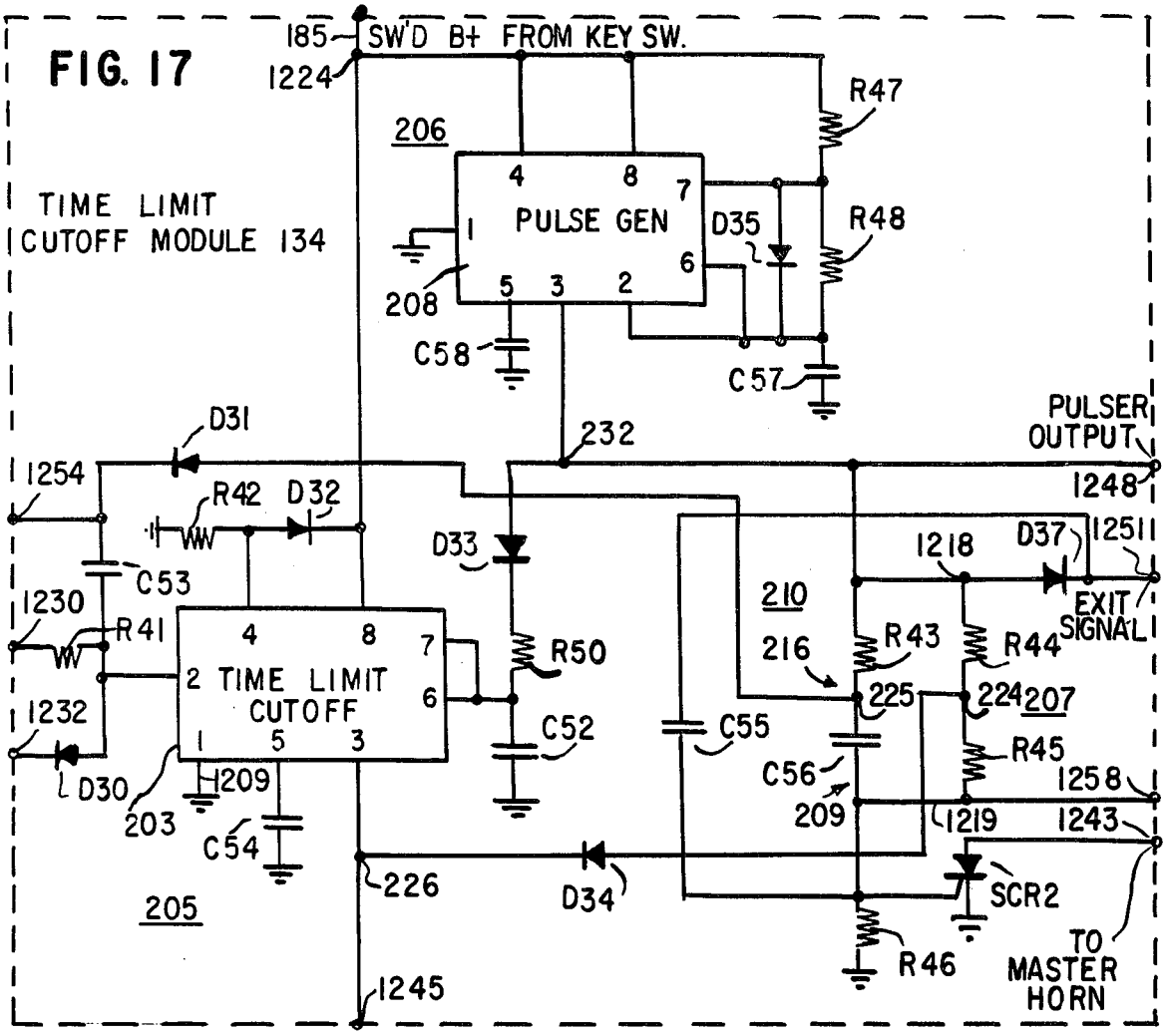
FIG. 17
TIME LIMIT CUTOFF MODULE 134
185
SW'D B+ FROM KEY SW.
1224
206
PULSE GEN
208
R47
R48
D35
C58
C57
232
PULSER OUTPUT
1248
D31
1254
R42
D32
C53
1230
R41
1232
D30
203
209
C54
205
TIME LIMIT CUTOFF
D33
R50
C52
226
D34
1245
210
216
R43
R44
225
224
207
C55
C56
209
R45
1218
D37
1251
EXIT SIGNAL
1258
1219
1243
SCR2
R46
TO MASTER HORN
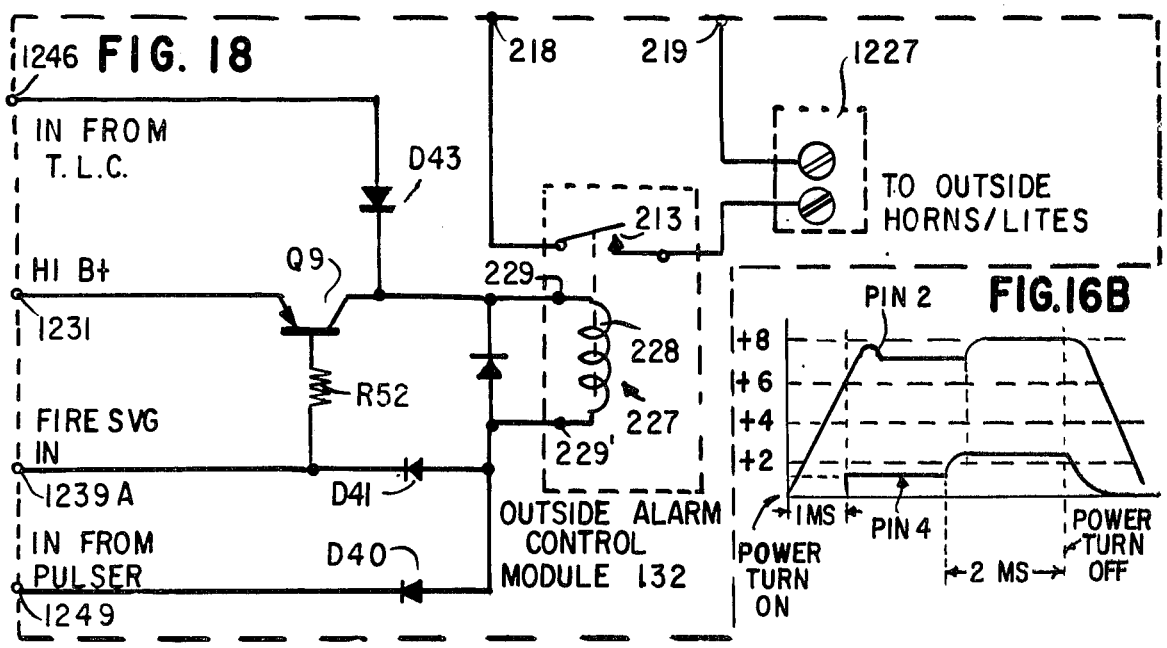
1246
FIG. 18
IN FROM T.L.C.
D43
HI B+
1231
Q9
R52
FIRE SVG IN
1239 A
D41
IN FROM PULSER
1249
D40
218
219
1227
213
229
228
227
229'
OUTSIDE ALARM CONTROL MODULE 132
TO OUTSIDE HORNS/LITES
FIG. 16B
PIN 2
+8
+6
+4
+2
1MS
PIN 4
POWER TURN ON
2 MS
POWER TURN OFF 1295
FROM TIME LIMIT CUTOFF
ONE-SHOT
2
4
8
3
1
5
6
7
234
250
1220
C60
C59
R53
251
252
D43
253
231
232
1256
TO BURG. DIALER
230
DELAYED BURGLARY DIALER MODULE 128
1220

B+KEYSWITCH
1221

1222
1226
C61
R54
R56
SERVICE B+ (KEY-SWITCH)
240
1226'
239
"SILENT" TROUBLE LAMP
4
8
7
1
5
3
2
6
238
R57
C62
C63
R55
D44
1257
LOOP MONITOR MODULE 126

TO OUTSIDE ALARM MODULE
1217
1216
3 AMP FUSE

VOLTAGE REGULATOR
261
260
262
264
HI B+
1201
D58
R58
265
LO B+
1203
263
GND
POWER SUPPLY MODULE 136
1206
267
268

SECURITY ALARM TRANSMISSION SYSTEM

BACKGROUND OF THE INVENTION

1. Field of the Invention

This invention relates to security alarm systems, and more particularly, to a fire and burglary detection system for providing alarm indications in response to the detection of a fire in a building or an unauthorized entry of the building.

2. Description of the Prior Art

Numerous security alarm systems have been proposed for detecting conditions such as fire or unauthorized entry of a building protected by the system and for providing suitable alarms in the event of detection of such conditions. Such systems generally include a plurality of sensing devices which are operable to detect conditions such as fire, smoke, unauthorized entry, etc. of a building protected by the system, and to provide suitable indications of the detection of such conditions to a common receiver which effects the generation of an audible alarm, for example, to alert occupants of the building to the condition detected.

Heretofore two types of security systems have been employed: (a) wired systems in which the sensors are connected directly to a control panel, and (b) wireless systems in which the sensors control suitable transmitter units to generate high frequency signals, generally in the RF band, for transmission to a receiver which is connected to a control panel.

When a large number of sensors are employed, a wired system becomes impractical both from the cost standpoint and the need for extending wires from the sensors to the receiver. The problem becomes more evident when one considers the increased capabilities of systems presently available. That is, not only do such systems provide for the detection of fire at locations throughout the building, the protection for numerous doors and windows, or guarding against an intruder who manages to avoid detection upon entering the building through the use of further sensors within the building, but also such systems may incorporate provisions for manually operated alarms, authorized entries, exit delays and other features. Moreover, the desirability of providing distinct alarm indications in response to the detection of different alarm conditions further complicates the layout and installation of the systems. Wireless systems are generally less expensive than wired systems. However, wireless systems are characterized by various interference problems, particularly those systems adapted for residential application. Such systems, which employ RF signalling to enable transmission of alarm indications from the transmitter units to the receiver, are susceptible to interference from RF signals generated by citizens band transmitters or from a similar security alarm system which protects a neighboring house. Likewise, RF alarm signals generated by transmitters of a system which protects a given house may also provide interference with a similar system employed in an adjacent house.

It is pointed out, the transmitter units of wireless systems are generally battery powered since it would be impractical to turn on each of the many transmitters located throughout the building whenever it is desired to activate the system. Accordingly, the receiver is generally turned off at times when the protection is not needed. Thus, even though a transmitter unit controlled by an entry switch for a protected door will provide an RF alarm signal whenever the door is opened, such signal will not cause an audible alarm to be provided when the receiver is deactivated.

However, where neighboring houses each employ RF security alarm systems, then should one system be activated while the occupants of the house protected by such system are away, the RF alarm signals generated by alarm transmitters which protect a neighboring house, as may be provided in response to opening a protected door or window while the receiver of such system is deactivated, may trigger a false alarm in the neighboring system. The alarm would result in the provision of an audible alarm and may also be transmitted to the police department or some other security watch service.

This interference problem can be minimized by making the transmitters and receivers adjustable to a number of frequencies. However, when two systems interfere with each other and adjustment of the transmitting frequencies is required after a system has been installed, a problem may arise in making a determination as to who will pay for such adjustments.

A further consideration is the installation requirements for the transmitter units. Various types of sensing devices, including heat detectors, entry switches, manual push-buttons and the like may be employed by a given system.

Thus, different applications will have different mounting and packaging requirements. For example, transmitter units associated with entry switches must be mounted near the doors and windows they protect.

With the large number of sensors to be mounted, it would be desirable to have universal alarm transmitter units which accommodate different types of alarm sensors and which are of small size and easy to install.

It would also be desirable to have a security alarm system for a building which minimizes the effects of interference from extraneous RF signals in the proximity of the building.

It would be further desirable to have a security alarm system employing battery operated transmitter units in which drain on the batteries is minimized.

SUMMARY OF THE INVENTION

It is therefore an object of the present invention to provide a security alarm system for a building which minimizes the effects of interference from extraneous radio frequency signals in the proximity of the building.

Another object of the invention is to provide a security alarm system for monitoring a plurality of different conditions and for providing alarm indications in response to the detection of one or more of the conditions.

A further object of the invention is to provide a transmitter unit for a security alarm system which is of small size and easy to install and which accommodates several different types of condition sensors.

Yet another object of the invention is to provide a security alarm system employing battery operated alarm transmitter units in which drain on the batteries is minimized.

These and other objects are achieved by the present invention which has provided a security alarm system including a plurality of condition sensors, each operable to provide an output for indicating alarm conditions for a building, for example, a plurality of alarm transmitter units, each associated with a different one of the condition sensors and enabled by the associated condition sensor in response to the detection of an alarm condition for the building to provide an alarm signal, and a receiver means to detect the alarm signals provided by the transmitter units and provide suitable alarm indications. The transmitter unit generates coded tone signals representing different alarm conditions, such as fire, burglary, or emergency conditions, and the receiver means detects the coded tone signals and recovers information from the coded tone signals which indicates the particular alarm condition provided. The receiver means may be located at a master control panel which includes suitable alarm indicator devices.

The system of the present invention employs inductive coupling to minimize the effects of radio frequency interference. To this end, the input of the receiver means is connected to a pickup loop which extends around the periphery of the protected building. The pickup loop couples the coded signals generated by the transmitter units to the receiver means. Accordingly, transmitter units located within the loop cause very strong signals to be generated in the loop. However, signals provided by transmitter units, such as transmitter units or other alarm systems, which are located a small distance outside of the loop do not cause detectable signals to be coupled to the loop. The transmitter units may be located above or below the vertical plane of the pickup loop and still couple signals to the pickup loop. Thus, in the system of the present invention, there is a controlled area of influence that being the area within the pickup loop pulse a small area outside of the loop. The use of inductive coupling serves to minimize interference with similar systems in nearby buildings and permits a lower detecting threshold to be used for the receiver means with an attendent minimization of the effect of extraneous radio frequency signals on the system.

The security alarm system of the present invention employs a modular concept. In accordance with a disclosed embodiment, each alarm transmitter unit is a self-contained unit including a battery power source, different alarm transmitter units being adapted to provide different alarm frequencies for indicating different alarms such as burglary, fire, or emergency. The master control panel utilizes a plug in modular concept for the receiver means in which various combinations of detecting and control modules required to provide alarm detection for a given alarm system are plugged into suitable connectors on the control panel.

The modular concept simplifies installation and permits the system to be "custom tailored" in the field to meet the customer's security needs. Thus, for example, a basic burglary alarm system can be upgraded, or a fire alarm system can be added to the basic system at a later date at very little additional cost over and above that of the added components. The security alarm system requires no wires between door/window switches, heat/smoke detectors and the master control panel. Accordingly, installation is effected faster and more easily, and, no special training is required for installers.

An additional benefit of the modular system of the present invention is gained in maintenance and repair. A defective system can be restored to service operation in a matter of minutes simply by determining by observation, which module is defective and replacing the detective module. This can be done by personnel without electronic knowledge and the defective module can be returned to the factory on an exchange basis for repair by skilled personnel.

In accordance with a disclosed embodiment, the transmitter units are battery powered and certain ones of the transmitter units which are associated with entry switches, for example, which protect doors and windows of the building are normally unenergized and are energized for a predetermined time in response to opening of the associated door or window to generate alarm signals, indicative of unauthorized entry or burglary, detectable by the receiver means.

Thus, even though a protected door or window may be left open for a long period of time, during periods of the day when free use of protected doors and windows is desired, the short time for which the associated transmitter unit is energized minimizes drain on the battery which energizes such transmitter unit.

The receiver means includes means for desensitizing the receiver means to burglary alarm signals during such periods. The receiver means also includes means for providing entry and exit delays, whereby an authorized person is permitted to enter or exit the protected building without causing an alarm.

In accordance with the present invention, the security alarm system may also provide automatic recharging of the batteries which energize the transmitter units of the system. To this end, the receiver means may include means for periodically generating power pulses at a predetermined frequency, the pulses being coupled to the pickup loop. Each transmitter unit may include a pulse detecting circuit which responds to the power pulses to supply charging current to the associated battery. This enhances the effectiveness and reliability of the system since battery drain is minimized during normal operation of the transmitter units and in that the batteries which energize the transmitter units are periodically recharged.

The present invention has also provided a construction and mounting arrangement which permits for an alarm transmitter unit installation which simplifies accommodation of a plurality of different types of alarm condition sensors. In a disclosed embodiment, the alarm transmitter unit comprises a housing means which houses the transmitter circuitry and a universal mounting bracket means which permits mounting of the housing means on either vertical or horizontal surfaces. The housing means is adaptable to receive external switch means or manually operated switch means for operating the transmitter circuitry. Moreover, the transmitter circuitry may also be controlled by heat detector switch means enabling the transmitter unit to be used as a fire detector. Thus, the transmitter unit provided by the present invention can be used for a wide variety of application.

DESCRIPTION OF THE DRAWINGS

FIGS. 10A–10D show waveforms for signals of the transmitter circuit shown in FIG. 8;

FIGS. 11A and 11B show waveforms of signals of the transmitter circuit shown in FIG. 9;

FIG. 15 is a schematic circuit diagram of an emergency alarm module of the receiver;

FIG. 16 is a schematic circuit diagram of a burglary alarm module of the receiver;

FIG. 16A shows the wave form for the signal at an output of a tone decoder circuit of the burglary module;

FIG. 16B shows the wave forms for signal levels at inputs of an entry delay circuit of the burglary module;

FIG. 17 is a schematic circuit diagram of a time limit cutoff module of the receiver;

FIG. 18 is a schematic circuit diagram of an outside alarm control module of the receiver;

DESCRIPTION OF A PREFERRED EMBODIMENT

General Description

Figure 1:
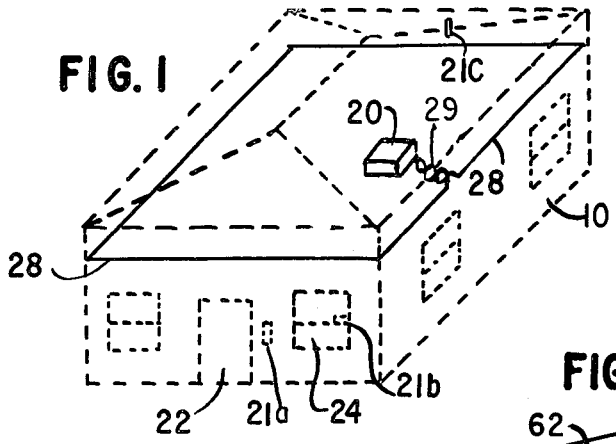
FIG. 1 is a simplified showing of the security alarm system provided by the present invention employed for protecting a building.

Referring to FIG. 1, the security alarm system provided by the present invention is shown employed in a building 10, for providing alarm indications in response to the detection of fire or unauthorized entry of the building 10. As shown in FIG. 1, the security alarm system includes a receiver 20 and a plurality of alarm transmitter units 21, such as transmitter unit 21*a*, shown associated with a door 22; a transmitter unit 21*b*, shown associated with a window 24; and a transmitter unit 21*c* which may be associated with a heat sensor. While only three transmitter units 21*a*–21*c* are shown in FIG. 1, it is apparent that many such transmitter units would be employed to protect the various doors and windows of the building and/or fire sensors in different rooms of the building.

Each of the transmitter units 21 includes a transmitter conduit (FIG. 8), operable in a manner to be described hereinafter to provide frequency shift keyed signals in response to the detection of a condition by an associated condition sensing device.

The system of the present invention employs inductive coupling to permit the signals provided by the transmitters 21 to be coupled to the receiver 20. To this end, the receiver 20 is connected to a pickup loop 28 which encircles the periphery of the building 10, preferably in the basement or attic area.

The pickup loop 28 and output windings of the transmitter circuits (FIGS. 8 and 9) are electromagnetically coupled in the manner of an air core transformer (i.e., inductive coupling), with the transmitter output windings serving as primary windings and the pickup loop 28 serving as a secondary winding.

The electromagnetic flux generated as the result of signals provided by the transmitter units link the pickup loop with the transmitter output windings causing current to be induced in the pickup loop 28. Since the transmitter units of a given system preferably are positioned within the pickup loop of that system the flux lines are heavily concentrated within the pickup loop and a strong signal is generated in the pickup loop. However, an activated transmitter unit located outside of the pickup loop by more than fifteen to twenty feet, for example, will not cause a detectable signal to be generated in the pickup loop due to the low concentration of flux lines which extend to the pickup loop as the result of signals from the externally located transmitter unit. In the vertical plane, the transmitter units may be located above or below the loop by as much as twenty-five feet, for example. Thus, the pickup loop 28 defines a controlled area of influence, that being the area within the pickup loop plus a small area outside the pickup loop 28.

Accordingly, the pickup loop 28 couples the FSK signals provided by the transmitter units 21 to the receiver 20 and limits the distance for which signals can be received which in the present example, if fifteen feet outside of the loop. The use of a pickup loop 28 in the manner of the present invention also permits the use of a lower detection threshold for the receiver 20. Thus, the possibility of interference from radio frequency signals generated by a transmitter unit of a similar system in a nearby building is substantially eliminated.

The receiver 20 detects the FSK signals provided by the transmitter units 21 and effects energization of a suitable alarm horn (not shown) to alert occupants of the building of the alarm condition. As will be described hereinafter, different audible alarms are provided for different conditions, such as the detection of a fire within the building 10 or an unauthorized entry of the building 10. The receiver 20 is located at a convenient location within the building, for example, in a central hallway for residential applications, and is connected to the pickup loop 28 over leads 29.

UNIVERSAL HOUSING UNIT

In accordance with the present invention, the transmitter units 21 are multi-purpose units which accommodate various types of condition sensors or switch devices. Thus, each of the transmitter units 21 are of the same physical construction and include a housing member, such as housing member 34 shown in FIG. 2A, which is adapted for use with different types of sensors including both normally open and normally closed switches which may be located internally or externally of the housing 34.

Figure 2A:
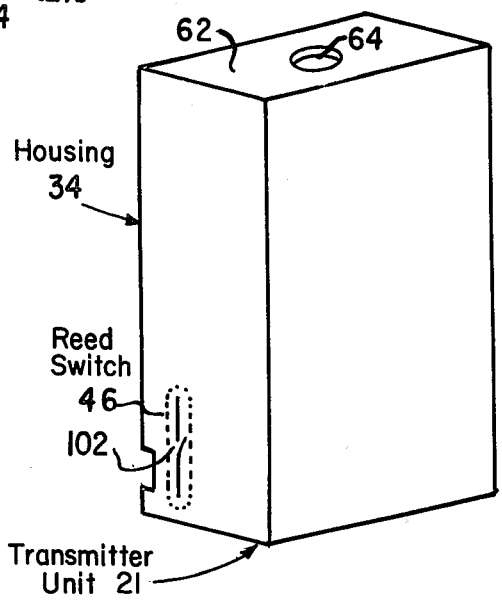
FIG. 2A is an isometric view of a one embodiment for a universal housing unit for a transmitter unit provided by the present invention.
Figure 2B:
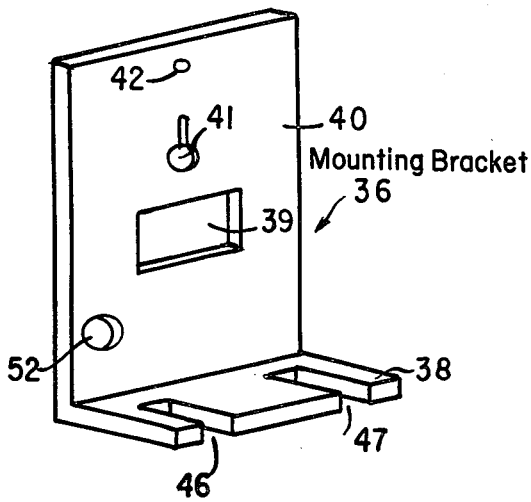
FIG. 2B is an isometric view of one embodiment for a mounting bracket for mounting the housing unit shown in FIG. 2A.
Figure 3:
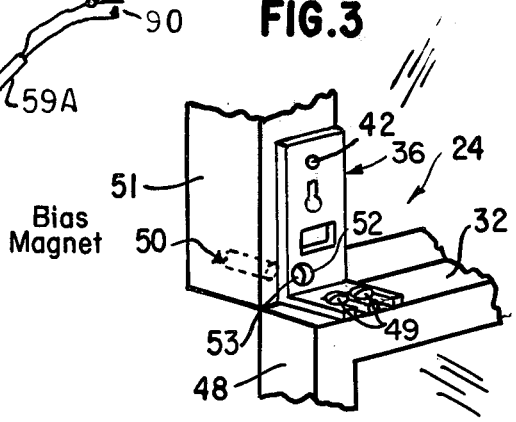
FIG. 3 shows the mounting bracket of FIG. 2B mounted on a window.

Referring to FIG. 2A, there is shown an isometric view of the housing unit 34 for the transmitter unit 21 for containing any of the transmitter circuits of the system. A mounting bracket 36, shown in FIG. 2B, permits mounting of the housing 34, by way of example, near a door, or a window, or on a wall. The mounting bracket 36 includes a base portion 38 and an upright portion 40, integrally formed with the base portion 38 and extending generally perpendicular therefrom. The mounting bracket 36 and housing 34 may, for example, be made of a high impact plastic. The base portion 38 of the mounting bracket 36 includes a pair of mounting slots 46 and 47 for receiving flathead screws 49 to permit mounting of the bracket 36 on a horizontal surface, such as the upper surfaces 32 of a window sash 48 as shown in FIG. 3. A further mounting slot 41 is provided in the upright portion 40 of the mounting bracket 36 to permit mounting of the transmitter unit 21 on a vertical surface, such as an inside wall of the building 10.

Figure 4:
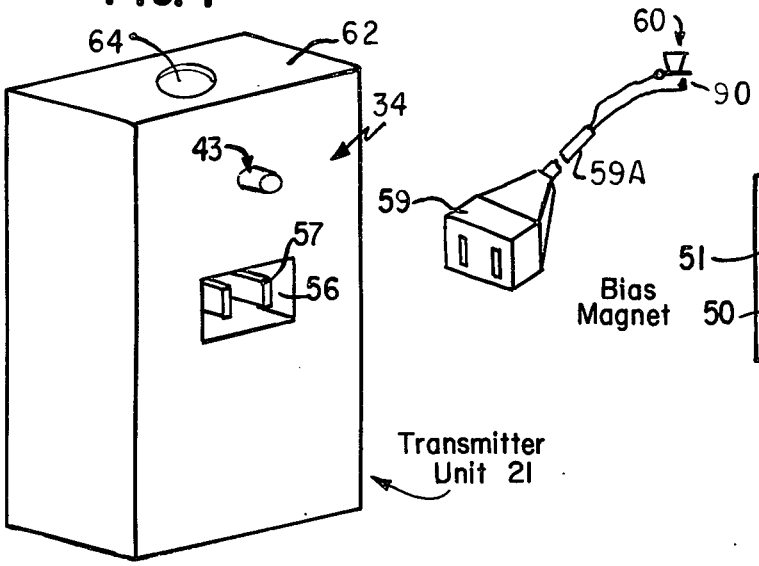
FIG. 4 is an isometric view of the rear portion of the housing shown in FIG. 2A.
Figure 8:
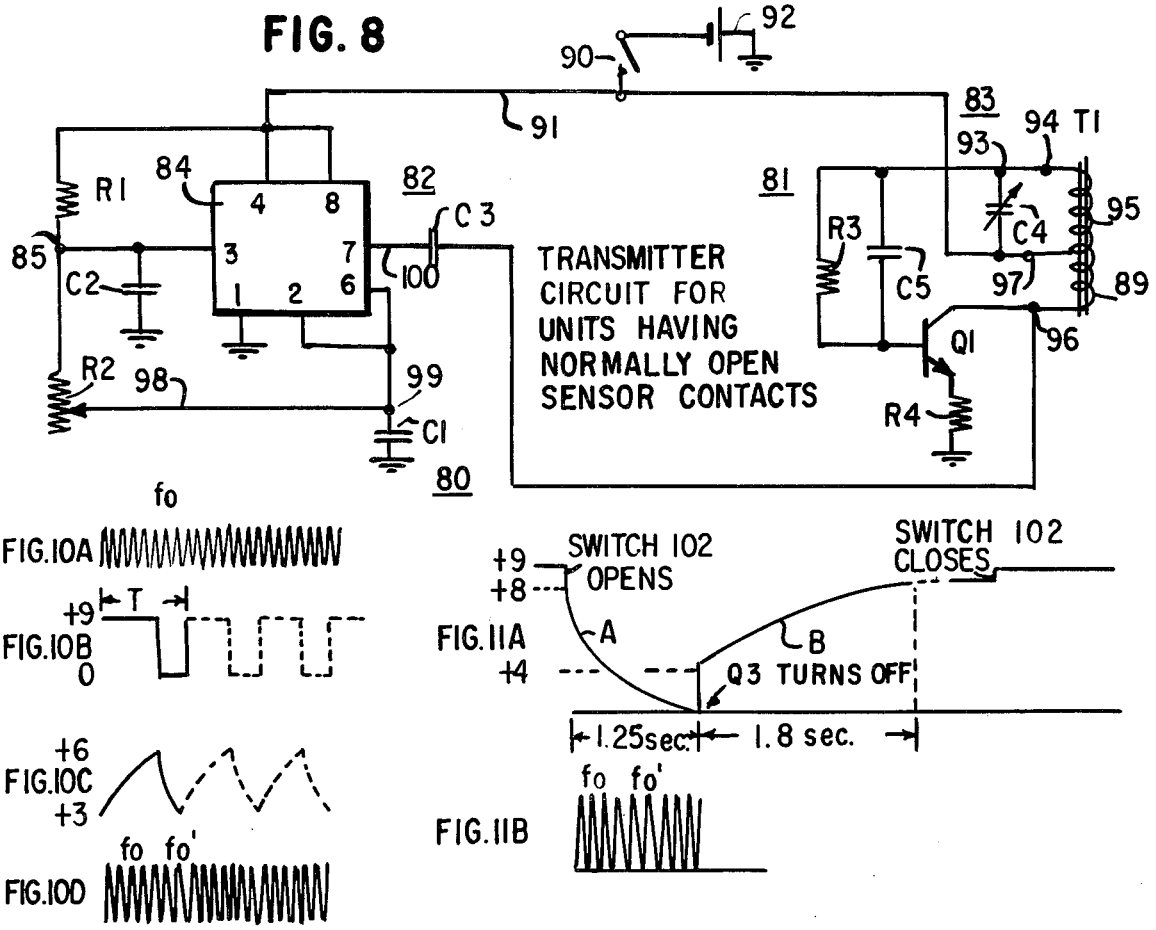
FIG. 8 is a schematic circuit diagram of a basic transmitter circuit which may be used for emergency or fire alarm transmitter units for the security alarm system of FIG. 1.
Figure 9:
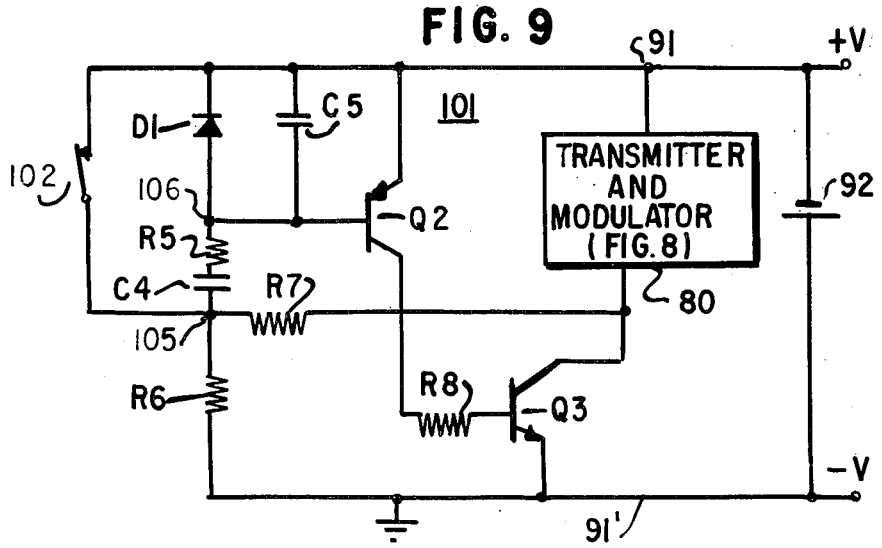
FIG. 9 is a schematic circuit and partial block diagram of a transmitter circuit for a burglary alarm transmitter unit for the security alarm system of FIG. 1.

Referring to FIG. 2A, the housing 34 comprises a generally hollow box-like structure in which is received the electrical components which comprise the transmitter circuit shown in FIGS. 8 and 9. As is best seen in FIG. 4, which is a rear view of the housing 34, a mounting stud 43 on the upper portion of the housing 34 is adapted to be received in an aperture 42 formed in the upright portion 40 of the mounting bracket 36 (FIG. 2A) to permit the housing 34 to be snapped onto the bracket 36.

The transmitter housing 34 is of small size, for example, may be 1¼ inches in width, and thus, may easily be mounted on a window or on a wall near a door.

As shown in FIG. 2A, a switching device may be mounted within the transmitter housing 34. The switching device 46, embodied as a reed switch, has contacts 102 connected to the transmitter circuit shown in FIG. 9 in a manner to be shown. The reed switch 46 is used, for example, for protecting both the bottom and top sashes of a double hung window. An associated biasing magnet 50, shown in FIG. 3, enables the contacts 102 to be normally closed when the window is closed. In other applications, such as for fire detection, the reed switch is not used, and an external switch having normally open contacts is employed to control the transmitter circuit shown in FIG. 8.

WINDOW TRANSMITTER UNIT

Referring to FIG. 3, when a transmitter unit 21, such as transmitter unit **21*b* (FIG. 1) is employed to protect a window 24 the mounting bracket 36 may, for example be mounted on the lower sash 48 of the window 24 either to the extreme left or right side and secured thereto by a pair of screws 49. A hole 53 is drilled in the vertical rail of the top sash 51 to receive a biasing magnet 50, which hole 53 is adjacent an aperture 52 in the bracket 36 when the housing 34 is positioned on the bracket 36. Thus, when the windows are closed, the magnet 50 is adjacent the contacts 102 of the reed switch 46, and the bias force of the magnet 50 is applied to the contacts 102 to maintain the contacts 102** closed.

When the window 24 is opened, the movement of the lower sash 48 (upper sash) relative to the upper sash 51 (or lower sash) causes the relative displacement of the reed switch 46 and the bias magnet 50, and the reed switch contacts 102 operate to enable the transmitter circuit in a manner to described.

EXTERNAL SWITCH TRANSMITTER

Referring to FIG. 4, the transmitter 21 may also be used to monitor the condition of a remote switch 60, such as a mat switch or some other manually operated switch, which may have normally open or normally closed switch contacts which are connected to the transmitter unit 21 by way of a plug and connector assembly. As shown in FIG. 4, recessed plug-in contacts 57 are provided on the rear portion of the housing 34 of the transmitter unit 21 opposite a cutout 29 in the mounting bracket 36 (FIG. 2B) to permit connection of wires from conventional door switches and/or a multitude of special switches which are used to protect sliding doors and windows, casement and jalousie windows, garage doors, etc. as well as to pressure sensitive mat switches. The plug-in contacts may be a standard automotive type plug. A mating connector 59 for the plug 57 is connected over a cable **59*a* to a suitable external switch 60. As will be shown, plug 57 is connected to a set of control inputs of the transmitter circuit which effect enabling of the transmitter circuit in response to the operation of the associated external switch 60. The cutout 39 in the mounting bracket 36 (FIG. 2B) permits the connector 59 to extend through the upright portion 40 of the bracket 36 permitting flush mounting of the housing 34 of the bracket 36**.

EMERGENCY TRANSMITTER UNIT

Figure 5:
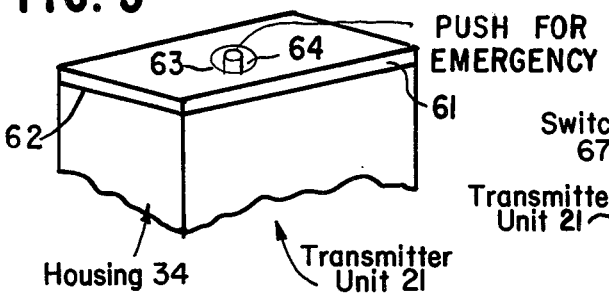
FIG. 5 shows a modification of the housing shown in FIG. 2A to incorporate a manually operated switch.

Referring to FIG. 5, there is shown a further application of the universal transmitter unit 21 wherein a cover plate 61, mounted on an upper surface 62 of the universal housing 34, mounts a recessed pushbutton switch 63 to the housing 34. The pushbutton switch 63 is secured to the cover plate 61 and extends through an aperture 64 in the upper surface 62 of the housing 34. Normally open contacts (not shown) of the pushbutton switch 63 are connected between the battery and the transmitter circuit shown in FIG. 8.

The transmitter 21 shown in FIG. 5 may be used as an emergency alarm transmitter for use by a bedridden person or may be used as a portable unit in the house to permit occupants of the house to initiate an alarm from any location within the house.

DOOR TRANSMITTER UNIT

Figure 6:
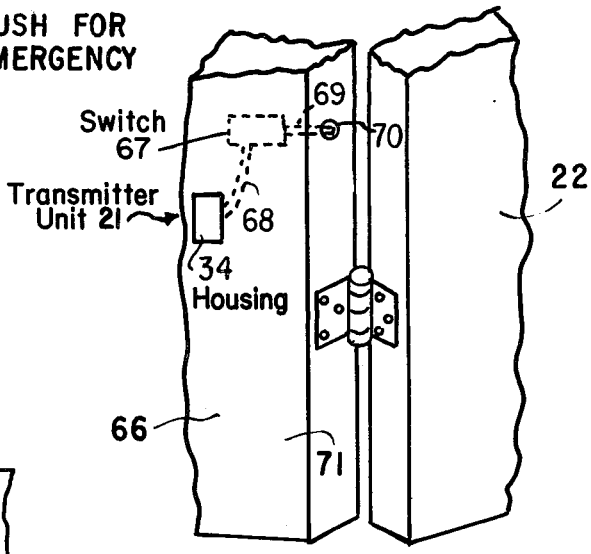
FIG. 6 shows an application of the transmitter unit with a door switch.

Referring to FIG. 6, there is shown a further application of the universal transmitter unit 21 for protecting a door 22. The transmitter housing 34 is shown mounted on the wall 66 adjacent the hinge side of the door 22 and connected to a suitable switch 67 over leads 68. The switch 67 has an operating plunger 69 which extends through an aperture 70 in the door frame 71.

When the door 22 is closed, the switch plunger 69 maintains normally open contacts (not shown) of the switch 67 closed so that the transmitter circuit (FIG. 9) is normally deenergized. When the door 22 is opened, the plunger 69 operates the switch 67 to open the switch contacts to permit energizing the transmitter circuit.

FIRE TRANSMITTER UNIT

Figure 7:
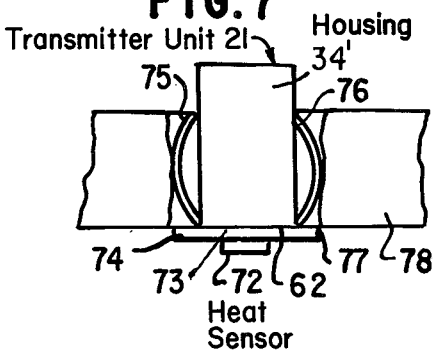
FIG. 7 shows an application of the transmitter unit with a fire or smoke detector.

Referring to FIG. 7, there is shown a further embodiment wherein the same transmitter unit 21 is employed with a fire or smoke detector. For example, transmitter 21 may be used with a thermostatic heat switch 72 in the manner of transmitter unit **21*c*, shown in FIG. 1, for detecting fire within the building 10. The fire transmitter unit 21*c* includes a housing package 34' which may comprise the universal housing 34 which is used in the other embodiments and having spring members 75 and 76 mounted on opposite sides of the housing 34. Installation of the fire transmitter 21c is simply accomplished by drilling a 2½ inch hole 77 in the ceiling 78 of the building room and inserting the housing package 34' into the hole 77. The spring members 76 and 76 will engage the sides of the hole 77 to maintain the transmitter housing unit 34' in position. The simplicity of installation, that is, there being no additional wiring needed, and the relatively small size of the housing unit 34'** are highly desirable features of the invention.

The heat sensor 72 extends through an aperture 73 in a cover plate 74, which is secured to the surface 62 of the universal housing 34, and through an aperture 64 (shown in FIG. 2A) in the surface 62 of the universal housing package 34.

The heat sensor 72 has normally open switch contacts (not shown) connected to the transmitter circuit (FIG. 8) as will be described. The thermostatic heat switch 72 is operated to enable the energization of the alarm transmitter circuit whenever the temperature in the proximity of the heat sensor 72 exceeds a predetermined temperature.

TRANSMITTER CIRCUITS

The system of the present invention employs frequency shift keying and the circuits in the transmitter units 21 are adapted to provide different modulating frequencies to represent the different alarm conditions, such as fire, burglary, or emergency. The basic transmitter circuit 80, shown in FIG. 8, which is used in the transmitter units 21 is a relatively simple circuit which includes an enabling switch 90, an oscillator circuit 81, a modulator circuit 82 which provides a modulating frequency for the oscillator circuit 81 whenever the transmitter circuit 80 is enabled, and an output circuit 83 for transmitting the modulated tones to the system loop 28. The enabling switch 90 may be the contacts of switch 63 of the emergency transmitter unit (FIG. 5), contacts of the heat sensor 72 of the fire transmitter unit (FIG. 7), or of other condition detectors which employ normally open switches.

The transmitter oscillator 81 is operable when energized to generate a radio frequency (RF) carrier signal at a predetermined frequency fo which in the exemplary embodiment is 120 KHz. The trnsmitter circuit 80 operates on a frequency shift keying basis with the 120 KHz output of the oscillator 81 being shifted down by the modulator circuit 82.

In the present example, the modulator circuit 82 for burglary alarm transmitter units provides a modulating frequency fm of 315 Hz, the modulator circuit 82 for fire alarm transmitter units provides a modulating frequency fm of 350 Hz, and the modulator circuit 82 for the emergency alarm transmitter units provides a modulating frequency fm of 390 Hz.

The transmitter units 21 are powered from a battery source 92, which for example may be a commercially available 9 volt battery. For the transmitter circuit 80 used in the fire and emergency transmitter units (FIGS. 5 and 7) or those employing external normally open switches, the normally open switch contacts of such switches are interposed between the battery 92 and a lead 91 which supplies power to the oscillator circuit 81 and the modulator circuit 82.

Referring to FIG. 8, the oscillator circuit 81 includes a transistor Q1, a tuned circuit 93 including a variable capacitor C4 and a transformer T1 connected in the collector circuit of the transistor Q1. The base of the transistor Q1 is connected over parallel connected resistor R3 and capacitor C5 to one terminal 94 of winding 95 of transformer T1. A second terminal 96 of the winding 95 is connected to the collector of transistor Q1. A tap 97 of winding 95 is connected to switch contacts 90 which are operable to connect the battery 92 to the oscillator circuit 81 and the modulator circuit 82. The capacitor C4, which is connected between terminals 94 and 97 of the winding 95, permits tuning of the oscillator circuit 81. The emitter of the transistor Q1 is connected over a resistor R4 to the negative terminal of the battery 92 which serves as reference or ground for the transmitter circuit 80. It is pointed out that the fire and emergency circuits employ normally open switches, and thus, there is normally no power drain on the battery 92.

The transformer T1 comprises a ferrite core 89 which in one embodiment included sixty-five turns of #33 wire, with ten turns for the tap between terminals 96 and 97. The ferrite core 89 is preferably positioned perpendicular to the plane of the pick-up loop 28 to optimize electromagnetic coupling therebetween. A capacitor C4, connected between terminals 94 and 95, tunes the upper section of the transformer T1. Transformer T1 acts as an autotransformer with the upper section out of phase with the lower section and permits oscillation by providing feedback from the collector to the base of transistor Q1. Resistor R3 is a bias resistor connected in the base circuit of transistor Q1.

The modulator circuit 82 includes a timing circuit 84, such as the type NE-555 timing circuit, commercially available from Signetics, which is connected for operation as an astable circuit. The timing circuit 84 has frequency determining components including a resistor R1 and a potentiometer R2 and capacitor C1 connected in a series circuit between conductor 91 and ground. The junction of resistors R1 and R2 at point 85 is connected to an input 3 of the timing circuit 84. Power is supplied to the circuit 84 from the battery 92 over contacts 90 to pins 4 and 8, and a ground reference is provided to pin 1. A trigger input, pin 2, of the timing circuit 84 is connected at point 99 to the junction of a capacitor C1 and a wiper 98 of potentiometer R2. A threshold input, pin 6, of the timing circuit 84 is also connected to point 99. The output pin 7 of the timing circuit 84 is coupled over a capacitor C3 to the collector of transistor Q1.

OPERATION OF THE TRANSMITTER

When switch contacts 90 are closed in response to an alarm condition, power is applied to the oscillator circuit 81 and modulator circuit 82 of the transmitter circuit 80. The oscillator 81 responsively generates a carrier signal, at frequency fo, shown in FIG. 10A, which in the exemplary embodiment is 120 KHz. Energization of the modulator 82 enables capacitor C1 to charge over a path from switch contacts 90 resistors R1 and R2, capacitor C1 to ground. Accordingly, capacitor C1 begins to charge linearly, as shown in FIG. 10C. When capacitor C1 has charged to +6 volts, the threshold level for the timing circuit 84, the timing circuit 84 turns on, and pin 7 of the timing circuit 84 goes from normally open to ground, as shown in FIG. 10B, grounding capacitor C3 at point 100, permitting capacitor C3 to discharge. As capacitor C3 is connected to ground, the 120 KHz frequency for of the oscillator 81 is shifted down in frequency approximately 2 KHz.

When capacitor C1 discharges rapidly as indicated in FIG. 10C, the output of the timing circuit 84 returns to +9 volts and the cycle repeats, at a rate determined by the timing circuit components, i.e., 350 KHz for fire alarm units, and 390 KHz for emergency alarm units.

BURGLAR TRANSMITTER UNIT

Referring to FIG. 9, there is shown a schematic circuit diagram of the burglary transmitter unit 21 which includes the transmitter circuit 80 and a control circuit 101 which serves to accommodate normally closed and normally open switches, such as switch 102 of the entry transmitter shown in FIG. 2A. The control circuit 101 maintains the transmitter circuit 80 deenergized and also minimizes drain on the battery by limiting the time during which the transmitter circuit 80 is energized to provide an alarm indication, as shown by the waveforms of FIG. 11A. Circuit 101 also minimizes battery drain when a door, for example, protected by the transmitter unit 80 is left open for a long period of time during normal daytime use.

Referring to FIG. 9, the control circuit 101 controls the charging and discharging of capacitor C4 which in turn controls the conductivity of transistors Q2 and Q3 which operate to connect power to the transmitter circuit 80. Capacitor C4 is connected in a series circuit which resistors R5 and R6 and a suitable poled diode D1 between conductors 91 and 91' which are connected to the positive and negative terminals of the battery 92. Switch 102 is connected in a shunt path from the junction of capacitor C4 and resistor R6 at point 105 and conductor 91 which is connected to the positive terminal of the battery 92 and the cathode of diode D1. Switch 102, which is a normally open switch is biased to a closed position by a bias magnet. When no bias magnet is used, switch 102 is normally open, and an external normally open door or window switch may be connected in parallel with switch 102, such switch being mechanically held normally closed by the door or window protected by such switch. The junction of resistor R5 and the anode of diode D1 at point 106 is connected to the base of transistor Q2. The emitter of transistor Q2 is connected to conductor 91 and the collector of transistor Q2 is connected over resistor R8 to the base of transistor Q3. The transmitter circuit 80 is connected between conductor 91 and the collector of transistor Q3, the emitter of transistor Q3 being connected to conductor 91' for supplying ground to the transmitter circuit 80 whenever transistor Q3 is turned on. A resistor R7 connected between point 105 and the collector of transistor Q3, causes Schmitt trigger action for fast turn on of transistor Q3.

OPERATION OF THE TRANSMITTER

Transistors Q2 and Q3 are normally cut off and thus ground is normally disconnected from the transmitter circuit 80. Capacitor C4 is normally discharged and the potential at point 105 is at approximately 9 volts as shown in FIG. 11A, while a small residual current flows over the switch 102 and resistor R6, resistor R6 is on the order of 3 meg ohms, and thus current drain on the battery 92 is insignificant. Switch 102 is opened in response to opening of the door or window protected by switch 102, capacitor C4 begins to charge over a path extending from the positive terminal of the battery 92 at conductor 91, over the emitter base circuit of transistor Q2, resistor R5, the capacitor C4, resistor R6 and over conductor 91' to the negative terminal of the battery 92. The potential at the base of transistor Q2 decreases, and base current flow causes transistor Q2 to turn on thereby supplying base current to transistor Q3 which also turns on connecting ground to the transmitter circuit 80 which generates RF frequency which shifts between fo, (120 KHZ), and fo', (118 KHZ), as shown in FIG. 11B, at a modulating rate of 315 Hz for the burglary transmitter. When capacitor C4 is charged, after a time of approximately 1.2 seconds, current flow stops, and transistor Q2 becomes cut off, thereby cutting off transistor Q3, disabling the transmitter circuit 80 and enabling capacitor C4 to discharge over resistor R5, diode D1 through transmitter circuit 80 through resistor R7 to capacitor C4, the potential at point 105 rising to approximately +8 volts. When switch 102 is again closed, the potential at point 105 returns to a +9 volts.

The control circuit 101 also allows the use of a normally open mat-type pressure switch (not shown). Switch 102 being normally open and the normally open mat switch connected in parallel therewith. When an intruder steps on the mat, the mat switch operates, discharging capacitor C4. Stepping off the mat then causes action identical to opening of switch 102.

RECEIVER-GENERAL DESCRIPTION

Figures 12, 12A:
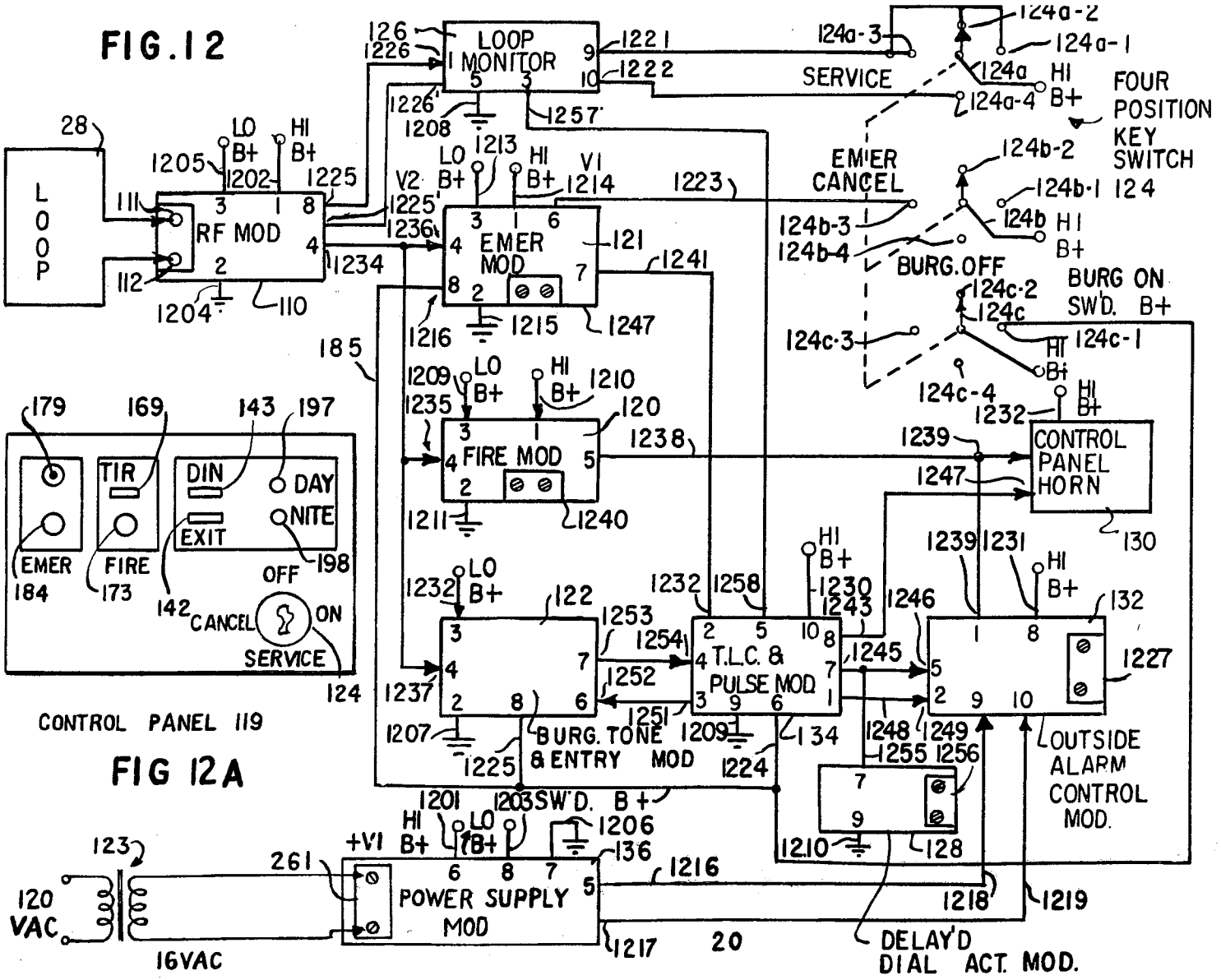
FIG. 12 is a block diagram of a modular receiver for the security alarm system of FIG. 1.
FIG. 12A shows the control panel of the receiver.

Referring to FIG. 12, there is shown a block diagram of an exemplary embodiment of a receiver 20 for the security alarm system of the present invention. The receiver 20 is located on a master control panel (FIG. 12A) which is located at a suitable location within the protected building. In accordance with the present invention, the receiver 20 is a modularized unit which in the exemplary embodiment includes ten modules shown in FIG. 12. The modules are pluggably connectable into suitable connectors (not shown) of the master control panel.

The system provides three separate wireless channels for fire/smoke, emergency and burglary alarms. The receiver 20 includes separate alarm detector modules 120, 121 and 122 for detecting fire/smoke, emergency and burglary alarm, respectively.

An RF module 110, connected to the pickup loop 28, detects the FSK signals provided by the transmitter units 21 and recovers the modulating tones at frequencies 315 Hz, 350 Hz, and 390 Hz which are extended to the detector modules 120–122.

A loop monitor module 126 continuously monitors the continuity of the pickup loop 28 and effects the generation of an alarm in the event of breakage of the pickup loop 28.

An outside alarm control module 132 energizes suitable alarm indicating devices in response to the operation of the fire/smoke alarm module 120, the emergency alarm module 121, or the burglary alarm module 122. The outside alarm control module 132 contains a heavy duty relay 212 (FIG. 18) which enables the connection of various types of horns, bells, lights, sirens, which are connectable to terminals 1227 of the module 134.

A time limit cutoff module 134 enabled by the burglary and emergency alarm modules controls the enabling of a control panel horn 130 and the control module 132, and limits the duration of audible alarms. A delayed burglary dialer actuator module 128 permits an alarm to be transmitted, after a predetermined delay, to a remote monitor which may be a local police station.

A power supply module 136 connected to a 120 VAC source over a transformer 123 supplies DC signals hi B+, which may be (+12 VDC), and 10 B+, which may be (+6 VDC) to the other modules of the receiver 20, and AC signals to the outside alarm control module 132. As shown in FIG. 12, an output terminal 1201 of power supply module 136 which provides hi B+ is connected to a terminal 1202 of the RF module 110, to a terminal 1214 of the emergency module 121, to a terminal 1210 of the fire module 120, to a terminal 1230 of the time limit cutoff module 134, to a terminal 1231 of the outside alarm control module 132, and to a terminal 1232 of the control panel horn 130.

A terminal 1230 of the power supply module 136, which provides lo B+, is connected to a terminal 1205 of the RF module 110, a terminal 1213 of the emergency module 121, a terminal 1209 of the fire module 120 and to a terminal 1232 of the burglary module 122.

A ground output is provided by the power supply module over a terminal 1206, which is connected to a terminal 1204 of the RF module 110, a terminal 1215 of the emergency module 121, a terminal 1211 of the fire module 120, a terminal 1207 of the burglary module 122, a terminal 1208 of the loop monitor module 126, a terminal 1209 of the time limit cutoff module 134 and a terminal 1210 of the delayed burglary dialer actuator module 128.

In addition, AC energizing signals for the outside alarm control module 132 are provided at output terminals 1216 and 1217 of the power supply module 136 which are connected to terminals 1218 and 1219 of the outside alarm control module 132.

A 4-position key-operated switch 124 permits selection of different operating modes for the security alarm system. The switch 124 is a three level switch having a wiper 124A associated contacts 124A1–125A4, wiper 124B and associated contacts 124B1–124B4, and wiper 124C with associated contacts 124C1–124C4. Wipers 124A–124C are connected to terminal 1201 of the power supply module 136 to receive the hi B+ voltage provided thereat. Contacts 124A1–124A3 of the first level of the switch 124 are connected together and to a terminal 1221 of the loop monitor module 126 to supply hi B+ to the loop monitor module 126 whenever wiper 124A engages any one of the contacts 124A1–124A3. Contact 124A4 is connected to a further terminal 1222 of the loop monitor module 126 to energize a trouble lamp 240 (FIG. 20) located on the control panel. Contact 124A4 corresponds to a "service position" and switch 124 is operated to the "service position" in the event of a trouble alarm provided by the loop monitor module 126.

The burglary system is turned on and off by the key switch 125 at level three including wiper 124C which extends switched B+ to the emergency module 121, burglary module 122 and time limit cutoff module 134 when wiper 124C engages contacts 124C1. Contact 124C1 is connected to a terminal 1224 of the time limit cutoff module 124 and a terminal 1225 of the burglary tone module 122. With the switch 124 in a position as illustrated in FIG. 12, the burglary system is deenergized. With the key switch 124 in the "burglary off" position, the emergency module 121, during an emergency alarm condition, supplies hi B+ to the time limit cutoff module 134 and portions of the burglary tone module overlead 185 which is connected between the terminal 1216 of the emergency module 121 and terminal 1225 and 1224 of the burglary tone module 122 and the time limit cutoff module 124. The burglary system is energized by operating the switch clockwise a quarter turn to connect hi B+ to terminal 124C1 over 124C.

Referring to the second level of the switch 124, the emergency alarm signal can be silenced only by operating the key switch 124 to the "emergency cancel" position by operating the key switch 124 counter clockwise a quarter turn such that hi B+ is extended over wiper 124B to terminal 124B3 which is connected to terminal 1223 of the emergency module 121.

The RF module 110 has a pair of input terminals 111 and 112 shown connected to the pickup loop 28. The audio frequency signals at frequencies 315 Hz, 350 Hz and 390 Hz recovered from the FSK signals coupled to the pickup loop 28 are provided at an output 1234 of the RF module 110 and extended to an input 1235 of the fire tone detector module 120, an input 1236 of the emergency tone detector module 121, and an input 1237 of the burglary tone detector module 122.

The fire tone detector module 120 is responsive to audio signals at a frequency of 350 Hz to provide an enabling signal at an output 1238 which is connected to an input 1239 of the control panel horn 130. The master control panel horn 130 provides an immediate continuous audible alarm to alert occupants of the building that fire or smoke has been detected. The alarm signal is automatically locked on at the control panel and can only be silenced by operating at fire test/reset switch 169 (FIG. 14) which is located on the master control panel. The fire tone detector module 120 may also energize a fire dialer (not shown) connectable to the terminals 1240 of the module 120 to transmit the fire alarm indication to the fire department.

The emergency tone detector module 121 is responsive to audio signals at a frequency of 390 Hz to effect intermittant enabling of the control panel horn 130 over the time limit cutoff module 134. The output 1241 of the emergency tone detector module 121 is extended to the input 1232 of the time limit cutoff module 134 which provides an output at 1243 which is extended to an input 1244 of the control panel horn 130. A further output provided at terminal 1245 of the module 134 is extended to an input 1246 of the outside alarm control module 132. The emergency alarm signal is cancelled by operating the key switch 124 to the "emergency cancel" position to connect hi B+ to the terminal 1223 of the module 121. The emergency tone detector module 121 may also effect energization of an emergency dialer (not shown) which is connectable to terminal 1247 of the module 121.

As will be described in more detail hereinafter, the time limit cutoff module 134 includes a pulse circuit 206 (FIG. 17) which provides a pulsating signal output at terminal 1248 of the module 134 which output is extended to an input 1249 of the outside alarm control module 132 to permit associated alarm devices to be driven intermittently at a frequency determined by the pulser circuit. The system provides a continuous alarm output for the fire alarm condition and an intermittant alarm, which may be one second on, one second off, for emergency and burglary alarms.

The burglary tone detector module 122 is responsive to audio tones at a frequency of 350 Hz to provide an output for enabling the control panel horn 130 and the outside alarm control module 132.

As noted above, the burglary system is turned off and on by the key switch 124 mounted on the control panel 119. Automatic exit and entry features are provided eliminating the need for, and additional cost of, installing key operated controls on the outside of the building. Referring briefly to FIG. 16, the burglary tone detector module 122 includes an exit delay circuit 139 which permits a person to leave the protected premises while the burglary system is energized without providing an alarm. An exit switch 142 is provided which when operated permits one opening and closing of any one outside door of the building. A subdued audible and visual warning is provided at the control panel which commences with the operation of the exit switch 142, and it continues until an exit has taken place thus eliminating the possibility of accidentially leaving the system in an exit mode.

The burglary tone detecting module 122 further includes an entry delay circuit 144 which provides a time delay which is adjustable from 5 to 30 seconds, for example during which time, the burglary alarm signal is inhibited to allow an occupant time to get to the control panel and shut the burglary system off by way of the key operated switch 124. During the entry period, the same subdued audible warning commences with the opening of the door, serving as a reminder to the occupant to shut the burglary system off at the control panel. A day/night switch 143 is provided, which when operated places the burglary system in the night mode. This bypasses the entry delay circuit 144 enabling the system to provide an alarm the instant the door is opened. Suitable indicators, including a day lamp 197 and a night lamp 198 indicates the mode of operation of the burglary system. The day lamp 197 and night lamp 198 are mounted on the control panel 119 (FIG. 12A).

Referring again to FIG. 12, whenever the exit switch 142 is operated, an exit signal provided at terminal 1251 of the time limit cutoff module 134 is extended to a terminal 1252 of the burglary tone detecting module 122 to supply power to the day lamp 197 or night lamp 198.

In the event of an alarm condition detected by the burglary tone detecting module 122, an output is provided at terminal 1253 of the burglary tone detecting module 122 which is connected to and input 1254 of the time limit cutoff module 134. Such signal effects enabling of the time limit cutoff module to limit the duration of the audible alarm provided in response to the detection of a burglary alarm tone provided by one of the transmitter units. The output provided at terminal 1254 of the time limit cutoff module 134 for enabling the outside alarm control module 132 is also extended to an input terminal 1255 of the delayed burglary dialer actuator module 128 to enable a suitable burglary dialer connectable to output terminal 1256 of the module 128 for transmitting the burglary alarm signal to a remote monitoring location, such as a local police department. The delayed burglary dialer actuator module 128 provides a 5 to 45 second, adjustable, delay before sending the alarm to the remote monitoring location to thereby minimize the possibility of false alarms being transmitted.

In most cases, the pickup loop 28 is installed within the building, such as in the basement or attic area of a residential building, but in some cases, this may be difficult or impossible, requiring the pickup loop 28 to be installed around the outside of the building, exposing the pickup loop 28 to accidental and/or deliberate breakage.

The loop monitor module 126 continuously monitors the continuity of the pickup loop 28. In the event of a breakage of the pickup loop 28, a trouble output signal is provided at terminal 1257 of the module 126, which is connected to an input 1258 of the time limit cutoff module 134, enabling an alarm to be activated at the master control panel. The trouble alarm is a rapidly pulsating tone at a frequency of ten pulses per second and is thus distinguishable from the fire, emergency and burglary alarms.

The trouble alarm can be silenced only by operating the master control panel key switch to the "service" position which automatically effects energization of a trouble lamp 240 (FIG. 20) located on the master control panel. It is pointed out, the audible trouble alarm signal is provided only by the master control panel horn and not by auxially horns which may be located outside of the protected building.

RECEIVER - DETAILED DESCRIPTION

Figures 13, 14:
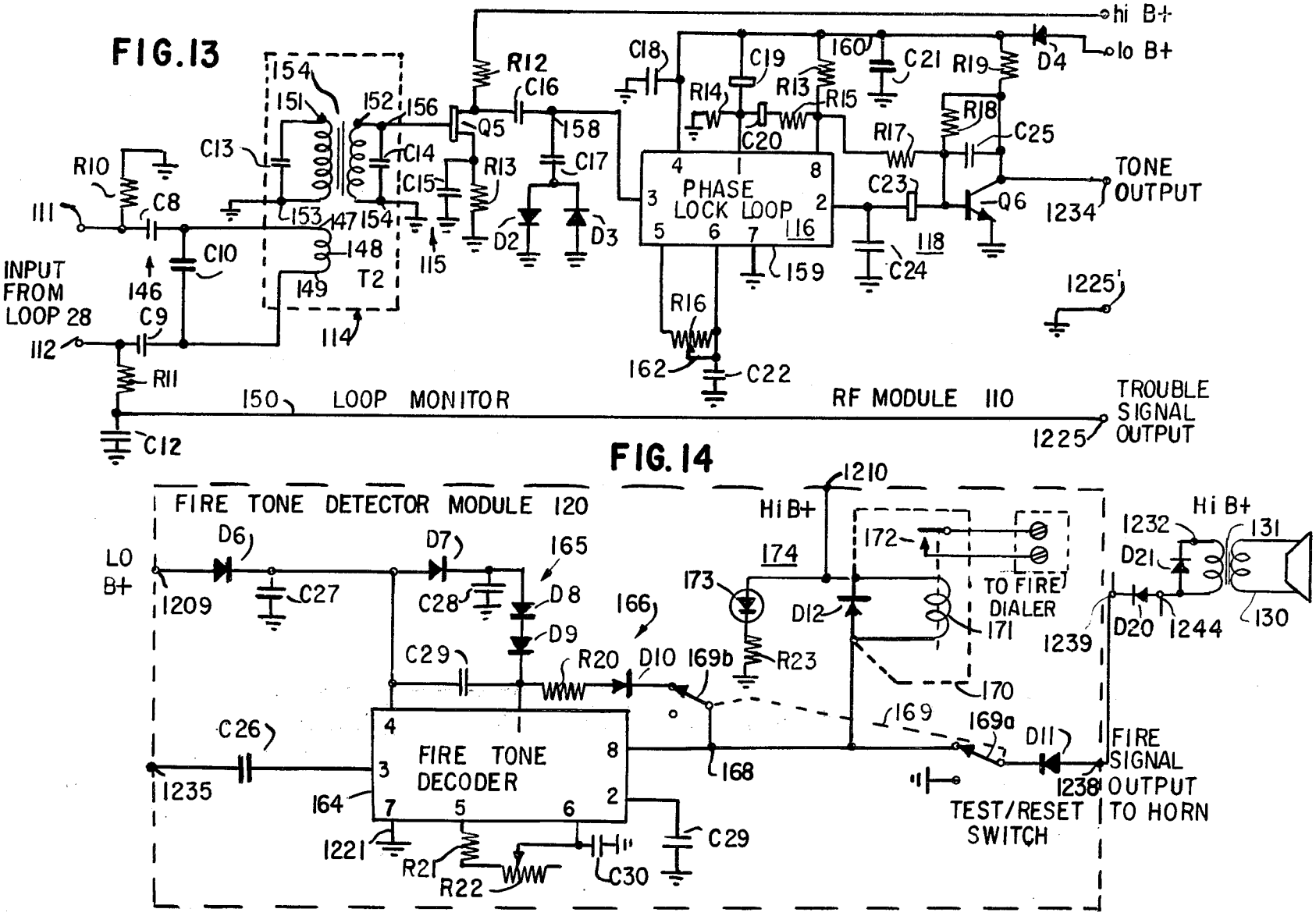
FIG. 13 is a schematic circuit diagram of an RF module of the receiver shown in FIG. 12.
FIG. 14 is a schematic circuit diagram of a fire alarm module of the receiver.

Referring to FIG. 13, which is a schematic circuit diagram of the RF module 110 of the receiver 20, the RF module 110 includes a selectivity and impedance matching circuit 114 having a matching network 146, which balances the impedance of the pick-up loop 28, and an RF transformer T2 which couples FSK signals from the pick-up loop 28 to a transistor Q5, which comprises an RF amplifier 115. The matching network 146 includes a capacitor C8 connected between input terminal 111 of the RF module 110 and one end of 147 of an input winding 148 of transformer T2 which has a second end 149 coupled over a capacitor C9 to input terminal 112 of the RF module 110. A capacitor 110 is connected in parallel with winding 148. The pick-up loop 28 is an A.C. referenced to ground on both sides over a resistor R10 connected between terminal 111 and ground, and a resistor R11 connected in series with a capacitor C12 between terminal 112 and ground. A trouble signal output lead 150, connected between the junction of capacitor C12 and resistor R11 is normally at D.C ground potential and provides an enabling signal at output 1225 to an input 1226 of the loop monitor module 126 (FIG. 12) to permit an alarm to be generated whenever the pickup loop 28 is broken due to tampering, for example.

Windings 151 and 152 and capacitors C13 and C14, which are connected in parallel with respective windings 151 and 152, form a tuned circuit which passes signals in a frequency range of approximately 118–120 KHZ to transistor Q5. Tuning slugs 154 and 155 of windings 151 and 152 permit tuning of the circuit to a frequency of the carrier frequency to 120 KHZ which are coupled to input winding 148 from the pick-up loop 28. Windings 151 and 152 are each connected to ground at one terminal.

Transistor Q5 of the RF amplifier circuit 115, is embodied as a field effect transistor having a gate electrode connected to one terminal 156 of the transformer T2, a drain electrode connected over a resistor R12 to hi B+ and a source lead connected to ground over resistor R13. The field effect transistor Q5 which has a high input impedance, minimizes loading effects on the tuned circuit 154.

Signals amplified by transistor Q5 are coupled to an input 158 of a tone decoder circuit 116 over a capacitor C16 and a limiter circuit, consisting of diodes D2 and D3 and a capacitor C17, which are connected between point 158 and ground.

The tone decoder circuit 116 comprises a phase lock loop circuit 159, such as the type NE567V Tone and Frequency Decoder, commercially available from Signetics. An input pin 3 of the commercial device 159 is connected to the input 158 of the tone decoder circuit 116 to receive signals provided at the output of the RF amplifier 115. The phase lock loop circuit 159 demodulates the RF signals to recover the audio frequency modulating tones at frequencies 315Hz, 350 Hz, or 390 Hz, and provides the audio frequency signals at a first output, pin 2 of the device 159. Pin 2 of the phase lock loop is coupled over a capacitor C23 to the base of a transistor Q6 which comprises an audio amplifier circuit 118. In addition, a squelch signal provided at a further output, pin 8, normally disables the audio amplifier whenever RF signals are not present at the input 158 of the tone decoder circuit 116.

Power at level lo B+ is supplied to the tone decoder circuit 150 over a diode D4, and a conductor 160 to a power input at pin 4 of the commercial unit 159. A high frequency filter capacitor C18 is connected between conductor 160 and ground. A reference input, at pin 7, is connected to ground.

Timing elements, including a variable resistor R16, having a resistance portion connected between pins 5 and 6 of the circuit 159 and a wiper 162 connected to pin 6, and a capacitor C22, connected between pin 4 and ground, determine the center frequency for the phase lock loop 159 which in the exemplary embodiment is 120 KHz.

The audio frequency signals recovered from the RF signals supplied to the tone decoder circuit 116 are provided at pin 2 of the phase lock loop 159, a filter capacitor C24, connected between pin 2 and ground, serves as a low pass filter to remove any 120 KHz signals from the audio output.

The audio output signals provided at pin 2 are coupled over capacitor C23 to the base of transistor Q6. A resistor R19 which is connected between the collector of transistor Q6 and lo B+, and a resistor R18, connected between the collector and the base of the transistor Q6 bias the transistor Q6 for operation as an audio amplifier. A capacitor C25 is connected in parallel with resistor R18 and the emitter of transistor Q6 is connected to ground.

However, when RF signals are not present at the input 158 of the tone decoder circuit 116, Transistor Q6 is maintained in a saturated condition by the squelch signal provided at pin 8 of the tone decoder circuit 116 which is connected over a resistor R17 to the collector of transistor Q6.

Pin 8, which is connected over a resistor R13 to conductor 160 is normally maintained at lo B+ potential which potential, extended over resistor R17 to the collector of transistor Q6, saturates transistor Q6 when no RF input is being supplied to the tone decoder circuit 116. Pin 8 of the phase lock loop 159 is also coupled over series connected resistor R15 and capacitor C20 to a filter input, pin 1 of the phase lock loop 159, which in turn is connected to ground over a resistor R14 and coupled to conductor 160 over a capacitor C19. A filter capacitor C21 is connected between conductor 160 and ground. The output of the RF module 110 at point 1234, which is the collector of transistor Q6, is extended to respective inputs, 1235, 1236, and 1237 of the fire tone detector module 120, the emergency tone detector module 121 and the burglary tone detector module 122.

In operation, when none of the transmitter circuits are energized to provide modulated RF signals, pin 8 of the tone decoder circuit 116 is maintained at lo B+ potential disabling transistor Q6.

When frequency modulated RF signals are being received by the RF module 110, internal circuits of the phase lock loop 159 cause the level at pin 2 to change at a rate determined by the transmitter modulation frequency (i.e. 315 Hz, 350 Hz, or 390 Hz) which determines the rate at which the RF signal is shifted between 120 KHz and 118 KHz. In addition, the presence of RF signals within the detection band of the phase lock loop 159, which includes 118 KHz to 120 KHz causes pin 8 to go to ground, enabling transistor Q6 to amplify the audio signals extended to transistor Q6 from the output of the phase lock loop 159. The amplified audio signals provided at output 1234 of the RF module are extended to the tone detector modules 120–122.

FIRE TONE DETECTOR

Referring to FIG. 14, there is shown a schematic circuit diagram of the fire alarm tone detector module 120. The fire alarm tone detector module 120 comprises a further Signetics NE-567 Tone Decoder circuit 164 operable as a phase lock loop. The tone decoder circuit 164 has an input at pin 3 coupled over a capacitor C26 to the input 1235 of the module 120 which in turn is connected to the output 1234 of the RF module 110. The tone decoder circuit 164 normally provides a signal at level lo b+ at an output 168 and provides a ground level output at point 168 whenever a sustained frequency within the selection band of the tone decoder circuit 164 is extended to pin 3 of the decoder circuit 164. The ground provided at output 168 is extended over a normally closed switch 169*a* of a fire test/reset switch 169 and an isolation diode D11 to output terminal 1238 of the fire alarm tone detector module 120 to effect energization of the master control panel horn 130 and the outside alarm control devices over the outside alarm control module 132 (FIG. 18).

The bandwidth center and output delay of the decoder circuit 164 are independently determined by external components including resistors R21–R22, and capacitors C29–C30. Variable resistor R22, which is connected with resistor R21 between pins 5 and 6 of the device 164, and capacitor C30, which is connected between pin 6 of the device 164 and ground, serve as a frequency selection network to establish the detection frequency for the device 164, which in the present embodiment is 350 Hz. Capacitor C29, which is connected between pin 2 and ground, serves as a low pass filter for the phase lock loop 164.

Power is supplied to a power input at pin 4 of the tone decoder circuit 164 from lo B+ at terminal 1209 over an input network 167 which includes a filter, comprised of a diode D6, which is connected between terminal 1209, pin 4 and a capacitor C27 connected between and pin 4 and ground. The network 167 further includes a noise inhibit circuit 165, including level shifting diodes D7–D9, which are serially connected between pin 4 and pin 1 of the decoder circuit 164, a filter capacitor C28, which is connected between the junction of diodes D7 and D8 and ground, and a filter capacitor C29, which is connected between pins 1 and 4 of the device 164, which assures that the tone decoder circuit 164 does not trigger falsely in the event of a momentary power failure.

The output 168 of the tone decoder circuit 164 is connected over switch 169*a*, diode D11 and output terminal 1238 of the fire alarm tone detector module 120 to the master panel horn 130 at terminal 1239 thereof, the master panel horn 130 has an operate winding 131 connected between hi B+ at terminal 1232 and a terminal 1244 which is connected over a diode D20 to terminal 1239. A diode D21 is connected in parallel with the control winding 131. In addition, terminal 1239 is connected to an input 1239A of the outside alarm control module 132 to permit energization of outside alarm devices.

The output 168 of the tone decoder circuit 164 may also be connected to an auxiliary alarm device control circuit 174 which includes a relay 170 having an operate coil 171 connected between hi B+ at terminal 1210 and point 168. A diode D12 is connected in shunt with winding 171. Relay 170 has normally open contacts 172 connected to terminals 1240 to which may be connected auxiliary alarm equipment such as a fire dialer (not shown), to permit a free alarm to be transmitted to the local fire department.

An indicator 173, embodied as a light emitting diode which may be located on the master control panel, is lit whenever power is applied to the fire alarm detector module 120.

A feedback circuit 166, including a diode D10 and a resistor R20, which are connected over a further normally closed switch **169*b* of the fire test/reset switch 169 between the output 168 of the tone decoder circuit 164, pin 8 of the commercial device, and pin 1 of the device 164, permits the tone decoder circuit 164 to be latched on whenever a ground level output is provided at pin 8. Thus, the tone decoder circuit 164, when enabled by an input signal at frequency 350 Hz, indicating a fire alarm, is automatically "locked on" maintaining the master control panel horn 130 and outside alarm devices energized. The fire alarm can only be silenced by operating the fire alarm test/cancel switch 169** which may be located on the mastercontrol panel. The fire alarm latch condition, which is achieved as long as the energized fire alarm transmitter is activated for at least one-half second, permits a fire alarm to be provided even though the activated fire alarm transmitter may be destroyed in less than a minute after the transmitter is activated.

The switch **169*a* of the fire test/reset switch 169, when operated connects ground to output terminal 1238 over diode D11 to effect energization of the master control panel horn 130 and the auxilliary alarm devices controlled by the outside alarm control module 132** for testing purposes.

EMERGENCY TONE DETECTOR

Referring to FIG. 15, there is shown a schematic circuit diagram of the emergency tone detector module 121 which is generally similar to the fire tone detector module 120 shown in FIG. 14, and includes a further Ne-567 Tone Decoder circuit 175 operable as phase lock loop. The input 1236 of the emergency tone decoder module 121 is connected to the output 1234 of the RF module 110. Audio signals provided at the output 1234 of the RF module are coupled over a capacitor C29 to an input of the tone decoder 175 at pin 3 which has a frequency selection network, including variable resistor R24 and a capacitor C30 which in the exemplary embodiment, sets the detection frequency for the tone decoder 175 at 390 Hz. The tone decoder circuit 175 normally provides an output at a level lo B+ and provides a ground level output whenever signals at frequency 390 Hz are supplied to the input of the tone decoder circuit 175.

Power is supplied to a power input at pin 4 of the tone decoder circuit 175 from lo B+ at terminal 1213 over an input network 177, including diodes D13–D16 and capacitors C23–C24, which provides the function of input network 167 of the fire tone detector module 120 as described above.

The output of the tone decoder circuit 175 at pin 8 is connected to point 176 and thence over a resistor R28 to an output terminal 1241 of the emergency alarm module 121 and to terminal 1232 of the time limit cut off module 134 (FIG. 17), which controls the energization of the master panel alarm horn 130 and alarm devices connected to outside alarm control module 132 for emergency and burglary alarms as will be shown hereinafter.

The output of the tone decoder 175 at point 176 is also connected to an auxilliary alarm device control circuit 180 which includes a relay 181 having an operate coil 182 with one end connected over an isolation diode D19 to hi B+ at terminal 1214 and the other end connected to point 176. A diode D18 is connected in shunt with winding 182 and a filter capacitor C36 is connected between the junction of diodes D18 and D19 and ground.

Relay 181 has normally open contacts 183 connected to terminals 1247 to which may be connected suitable auxilliary alarm equipment such as special lights, horns, a telephone dialer or the like.

The output of the tone decoder circuit 175 at point 176 is connected over a resistor R28 to an input 1232 of the time limit cutoff module 134 (FIG. 17). The change from lo B+ to ground at point 176 enables a timing circuit 203 and pulse generating circuit 206 thereof, which control a silicon controlled rectifier SCR2, to provide intermittant drive to the master panel horn 130 (FIG. 14), which has an input terminal 1244 connected to an output terminal 1243 of the time limit cutoff module 134, and to the alarm devices controlled by the outside alarm control module 132 (FIG. 18), which has an input terminal 1246 connected to an output termainal 1245 of the time limit cutoff module 134.

Referring to FIG. 15, a ground level at point 176 also permits energization of an indicating device 184, embodied as a light emitting diode, which is connected in series with a resistor R40 between point 176 in hi B+. The indicating device 184 may be located on the master control panel to provide a visual indication at the control panel that an emergency condition exists.

A normally open emergency alarm switch 179, which may also be located on the master control panel, is manually operable to connect ground to point 186 thereby enabling the tone decoder circuit 175 to provide a ground level at point 176 for enabling the master panel horn 130 and the auxilliary apparatus as described above.

A feedback circuit 178, including a diode D17 and resistors R25–R26, which are connected between point 176 and pin 1 of the tone decoder circuit 175, permits the tone decoder circuit 175 to latch on whenever a ground is provided at output 176.

The tone decoder circuit 175 is disabled by operating the key switch 124 (FIG. 12) to the emergency cancel position which causes hi B+ to be extended over resistor R26 to pin 1 of the decoder circuit 175 which unlatches the decoder circuit 175.

As indicated above, the key switch 124 is operable to supply switched B+ to the burglary tone detector module 122 and the time limit cutoff module 134. However, when the burglary system is turned off by way of switch 124, the burglary module 122 and the time limit cutoff module 134 are deenergized.

Accordingly, in the event an emergency alarm is to be provided while the burglary system is off, the emergency module 121 supplies an energizing potential at level hi B+ to the time limit cutoff module 134 over a conductor 185 (FIG. 12) which connects a terminal 1226 of the module 121 to a terminal 1224 of the module 134.

To this end, the emergency tone detector module 121 includes a power switch circuit 135 including a transistor Q7 having an emitter-collector circuit connected between hi B+ and terminal 1226. The base of transistor Q7 is connected over a resistor R27 to point 176. Transistor Q7 is normally cutoff, but is enabled whenever a ground is provided at point 176 to extend hi B+ to the time limit cutoff module 134 over conductor 185 to permit operation of the master control panel horn 130 and alarm devices controlled by the outside alarm control module 132.

BURGLARY TONE DETECTOR MODULE

Referring to FIG. 16, there is shown a schematic circuit diagram of the burglary alarm tone detector module 122. The burglary module 122 comprises a burglary tone decoder circuit 188, an entry/exit circuit 139, and an entry delay circuit 144. The tone decoder circuit 188 detects the tone signals provided at the output of the RF module 110 and provides a control output at point 190. The entry/exit circuit 139 extends the control output to the time limit cutoff module 134 (FIG. 17) via the entry delay circuit 144, which delays enabling of the time limit cutoff module 134 for a predetermined time before an audible alarm is provided. Such delay permits an authorized entry of the protected building without providing an alarm.

The burglary tone decoder circuit 188 is similar to the fire tone decoder 164 (FIG. 14) and includes a Signetics Type NE-567 Tone Decoder Circuit, operable as a phase lock loop. The tone decoder circuit 188 has an input at pin 3 coupled over a capacitor C38 to an input 1237 of the burglary module 122 which in turn is connected to the output terminal 1234 of the RF module 110. The tone decoder 188 includes a frequency selection network, including a variable resistor R30 and a capacitor C43 which, in turn exemplary embodiment, sets the detection frequency for the burglary alarm tone decoder circuit 188 at 315 HZ.

Power is supplied to a power input at pin 4 of the tone decoder circuit 188 from lo B+ at terminal 1232 over an input network 189, including diodes D22–D25 and capacitors C39–C41, which provide the function of input network 167 of the fire tone detector module 120 as described above.

The output of the tone decoder circuit 188 at pin 8 is connected to point 190. The output of the decoder circuit 188 is normally at lo B+ level and is shifted to a ground level whenever at a frequency of 315 Hz are coupled to the decoder circuit 188 from the RF module 110. A feedback circuit, including capacitor C42 and a resistor R29, is connected between the output of the tone decoder circuit 188 at point 190 and pin 1 of the phase lock loop to prevent chatter.

The entry/exit circuit 139 includes a normally nonconducting transistor Q8 which is operable when enabled to extend the ground level provided at point 190 to the entry delay latch circuit 144. A silicon controlled rectifier SCR1 which is normally conducting when power is supplied to the burglary module 122 controls the enabling of the transistor Q8.

Referring to FIG. 12, power is supplied to the entry/exit circuit 139, as well as the entry delay circuit 144, from the key switch 124. When the key switch 124 is in the position shown in FIG. 12, the burglary system is turned off, and the entry/exit circuit 139 and entry delay circuit 144 are deenergized. When the key switch 124 is operated a quarter turn clockwise, hi B+ is connected over switch 124C to terminal 1225 of the burglary module 122.

Referring to again FIG. 16, the silicon controlled rectifier SCR1 has an anode connected to a terminal 1225, which is connected to contact 124C1 of switch 124 (FIG. 12), and a cathode connected over a resistor R35 to ground. A capacitor C46, connected between the anode and the gate of silicon controlled rectifier SCR1, functions to trigger the silicon controlled rectifier SCR1 on, activating the burglary detector circuit when the key switch 124 is operated to the "burglary on" position. The gate of the silicon controlled rectifier SCR1 is connected to ground over a resistor R32 and is coupled over capacitor C45 to point 190 at the output of the decoder circuit 188. Resistor R32 prevents false triggering of the silicon controlled rectifier.

The junction of switch 142 and resistor R35 and the cathode of silicon controlled rectifier SCR1 at point 146 is connected over resistor R31 and diode D27 to the base of transistor Q8. Transistor Q8 has its emitter connected directly to point 190 at the output of the decoder circuit 188, and its collector connected over a resistor R36 to switched B+ at terminal 1225, and to a trigger input at pin 2 of the entry delay circuit 144.

When the burglary system is turned on by operating the switch 124, switched B+ is applied to terminal 1225 of the burglary module 122, and the silicon controlled rectifier SCR1 is rendered to conductive by the charging of capacitor C46 to establish a potential at point 146 which is extended over resistor R31 and diode D27 to the base of transistor Q8.

The hi B+ level at terminal 1225 is also extended over a resistor R33 and a diode D26 to point 190 to maintain transistor Q8 normally off. Transistor Q8 is enabled whenever a ground level is provided at point 190 and extends such ground to the trigger input pin 2 of the entry delay circuit 144. Resistor R31, together with a capacitor C48, which is connected between the junction of resistor R31 and diode D27, form a delay network 147 which provides an operating delay for transistor Q8.

The exit switch 142 of the entry/exit circuit 139 is a normally open, spring return switch, operable to permit temporary disabling of the entry/exit circuit 139, by shunting current around silicon controlled rectifier SCR1, which turns it off, preventing the entry/exit circuit from responding to the burglary tone decoder 188 thereby permitting one opening and closing of any one of the outside doors without providing an alarm.

The entry delay latch circuit 144 comprises a timing circuit 200, which may be the Signetics Type NE-555 Timer Circuit, connected for operation as a one-shot circuit. The trigger input at pin 2 of the device 200 is connected to the collector of transistor Q8. A noise inhibit circuit 148 including a resistor R38' and a Zener diode D28, connects the reset input pin 4 of the circuit 200 to switched B+ to avoid false triggering of the timing circuit 200 in a manner to be described hereinafter. The Zener diode D28 is connected between the reset pin 4 and a power input pin 8 of the device 200 which is connected to switched B+ at terminal 1225. Resistor R38' is connected between pin 4 and ground.

The delay period of the entry delay latch circuit 144 is determined by a delay adjust network 151, including resistor R37–R39, and a capacitor C50. Resistors R37 and R38 are serially connected with capacitor C50 between terminal 1225 and ground. The junction of resistor R38 and capacitor C50 at point 152 is connected to pins 6 and 7 of timing circuit 200.

Resistor R39 is connectable over a switch S1B of the Day/Night mode select switch 143 in shunt with the resistors R37 and R38. When switch 143 is in the Day position as illustrated in FIG. 16, the time constant for the delay latch 200 is determined by resistors R37 and R38 and capacitor C50. Variable resistor R38 permits the entry delay to be adjustable from five to thirty seconds, for example.

When switch S1B is operated to the night position, the resistor R39 shunts resistors R37 and R38, effectively bypassing the entry delay circuit 144, reducing the entry delay to less than one second, permitting almost immediate enabling of the time limit cutoff module 134 whenever an alarm tone is detected by the burglary tone decoder circuit 188.

The Day/Night switch 143 includes a further switch S1A which is mechanically linked with switch S1B and is operable to connect ground to suitable Day/Night indicators 197 and 198, which may be light emitting diodes located on the control panel, which receive switched B+ from point 142 which is connected over a diode D29 and a resistor R34, to the indicators 197 and 198 (FIGS. 12 and 12A).

Pulsed hi B+ is continuously supplied by the time limit cutoff module 134 over terminal 1252 and resistor R34 to either indicator 197 or 198 whenever the key switch 124 is in the "burglary on" position. However, if silicon controlled rectifier SCR1 is on, continuous B+ is also supplied to the indicators 197 or 198, via diode D29, maintaining indicator 197 or 198 continuously on.

Accordingly, when the burglary system is turned on at the key switch 124, one of the indicators 197 or 198 is lit to indicate that the burglary system is operating in the Day or Night mode.

The entry delay circuit 144 normally provides a ground level output at terminal 1253 of the module 122 which is connected to terminal 1254 of the time limit cutoff module 134. The lever at terminal 1253 goes from ground to high B+ whenever the entry delay circuit 144 is enabled and remains at hi B+ until the delay circuit 144 times out.

When the entry delay latch circuit 200 times out, the output level at terminal 1253 goes from hi B+ to ground, providing a negative going output, which is coupled over a capacitor C53 (FIG. 17) to a trigger input pin 2 of the time limit cutoff circuit 230 to effect energization of alarm control apparatus controlled by the time limit cutoff module.

TIME LIMIT CUTOFF MODULE

Referring to FIG. 17, there is shown a schematic circuit diagram for the time limit cutoff module 134 which controls the energization of the master panel horn 130 and the outside alarm control module 132, which limits the duration of audible alarms provided for burglary or emergency conditions. The module 134 includes a time limit circuit 205, a pulse generating circuit 206, and a control circuit 210. A bias voltage at level hi B+ is supplied to the time limit cutoff module 134 at terminal 1230, and switched B+ is supplied to terminal 1224 of the module 134 over the key switch 124.

The time limit circuit 205 may comprise a timing circuit 203, such as the Signetics Type NE-555 Timer Circuit, connected for operation as a one-shot circuit. The timing circuit 203, normally provides a ground level output at pin 3 thereof, and is responsive to an input signal supplied to a trigger input pin 2 by the entry delay 144 or the emergency tone decoder circuit 175 to provide an output at level hi B+ at pin 3 for a pre-determined duration, which, for example, may be four minutes, which duration is established by a resistor R50 and a capacitor C52.

The timing circuit 203 has a power input at pin 8 connected to switched B+ at terminal 1224. A noise inhibit network 231, including a resistor R42 and a Zener diode D32, inhibits the timing circuit 203 to avoid false triggering on power failure and/or restoration of power to the circuit 203. The Zener diode D32 is connected between a reset pin 4 of the timing circuit 203 and the power input pin 8 of the timing circuit 203. A resistor R42 is connected between pin 4 and ground. Ground is connected to pin 1, and a capacitor C54 is connected between pin 5 and ground.

The trigger input pin 2 of the timer circuit 203 is connected over a capacitor C53 to terminal 1254 of the module 134 which, in turn, is connected to the output of the entry delay circuit 144 (FIG. 16) at terminal 1253. The trigger input is also connected over a resistor R41 to terminal 1230 of the module 134, which is connected to hi B+ for providing a bias level at pin 2 of the timing circuit 203, and over a diode D30 to terminal 1232 of the module 134, which is connected to the output of the emergency tone decoder circuit 175 (FIG. 15) at terminal 1241.

The timing circuit 203 has pins 6 and 7 connected to the junction of resistor R50 and capacitor C52 which are connected in series with a diode D33 between a point 232 at the output pin 3 of the pulse generating circuit 206 and ground.

The pulse generating circuit 206 may comprise a Signetics Type NE-555 timing circuit 208 connected for operation as an astable multivibrator to provide pulses at output pin 3 thereof at a rate determined by resistors R47 and R48 and a capacitor C57. Resistors R47 and R48 and capacitor C57 are serially connected between terminal 1224 and ground, and a diode D35 is connected in parallel with resistor R48. Power is supplied to a power input pin 8 of the timing circuit 208, which is commonly connected with pin 4 to switched B+ at terminal 1224 of the module 134. A pin 1 of the timing circuit 208 is connected to ground, and a pin 5 is coupled over a capacitor C58 to ground. A pin 7 of the timing circuit 208 is connected to the junction of resistors R47 and R48, and pins 2 and 6 of the timing circuit 208 are commonly connected to the junction of resistor R48 and capacitor C57.

When the burglary system is energized by key switch 124, so that switched B+ is applied to terminal 1224, the timing circuit 208 is operable to provide output pulses at pin 3 at a rate determined by the frequency setting components, resistors R47 and R48 and capacitor C57. Whenever an alarm indication is to be provided in response to the detection of an entry into the protected building or for an emergency condition, the pulses provided by the pulse generator circuit 206 are supplied to the control circuit 210 to provide a variable drive to the gate of a silicon controlled rectifier SCR2 thereof. The silicon controlled rectifier SCR2 controls the energization of the master control panel alarm horn 130 (FIG. 14). The pulses are also extended over diode D36 to the outside alarm control module 132 (FIG. 18) at terminal 1249 for controlling the alarm devices connectable thereto.

The control circuit 210 includes the silicon controlled rectifier SCR2 and a timing circuit network 216 which permits intermittant drive to be provided to the silicon controlled rectifier SCR2. The silicon controlled rectifier SCR2 has an anode connected at terminal 1243 of the module 134 to the master control panel horn 130 at terminal 1244. The cathode of the silicon controlled rectifier SCR2 is connected to ground. The gate of silicon controlled rectifier SCR2 is connected over a resistor R46 to ground and to an output of the control network 216 at point 219.

The control network 216 includes two parallel branches 207 and 209 connected between point 219 and a point 218 which is connected to the output of the pulse generating circuit 206 at point 232. Branch 207 comprises series connected resistors R44 and R45. The junction of the resistors R44 and R45 at point 224 is connected over a diode D34 to point 226 at the output of the time limit cutoff circuit 215, which is normally at ground potential thereby grounding point 224, preventing the pulses from being extended to the silicon controlled rectifier SCR2 whenever the time limit cutoff circuit 205 is disabled. When the time limit cutoff circuit 205 is enabled, diode D34 is reverse biased removing ground from point 224, permitting the silicon controlled rectifier SCR2 to follow the output of the pulse generating circuit 206, driving the master panel horn 130 intermittantly at the same duty cycle as the pulse generating circuit 206 which, for example, may be one second on and one second off.

Branch 209 comprises a resistor R43 and a capacitor C56 which are connected in series between points 218 and 219. The junction of resistor R43 and capacitor C56 at point 225 is connected over diode D31 to terminal 1254 of module 134 to receive the entry signal provided by the entry delay circuit 141. Terminal 1254 is normally maintained at ground potential, thereby grounding point 225 to prevent the pulses provided by the pulse generating circuit 206 from being extended to the gate of the silicon controlled rectifier SCR2.

Whenever an entry signal is provided at terminal 1254 by the entry delay circuit 144, terminal 1254 goes positive reverse biasing diode D31 thereby removing ground from point 225 permitting the pulses to turn on the silicon controlled rectifier SCR2 through capacitor C56, which charges at a rate of approximately five milliseconds resulting in extremely short alarm pulses from the control panel horn 130 thus providing a subdued "entry" signal.

The output of the pulse generating circuit 206 at point 232 is connected over a diode D37 to the junction of diode D29 and resistor R34 at terminal 1252 of the burglary module 122 (FIG. 16). Whenever silicon controlled rectifier SCR1 is conducting, terminal 1251, which is connected to terminal 1252, is maintained at switched B+ potential, reverse biasing diode D37. Whenever the exit switch 142 is operated, diode D37 becomes forward biased permitting the pulses to be extended over resistor R34 to drive the Day/Night indicators 197 or 198 intermittantly at the rate of the pulse generating circuit 206. In addition, the pulses are also coupled over a capacitor C55 which provides short pulses to the gate of silicon controlled rectifier SCR2 resulting in a subdued "exit" signal.

OUTSIDE ALARM CONTROL MODULE

Referring to FIG. 18, there is shown a schematic circuit diagram of the outside alarm control module 132. The outside alarm control module 132 basically comprises a control relay 212 having normally open contacts 213 operable to connect 16VAC signals extended to terminals 1218 and 1219 of the alarm control module 132 from the supply power module 136 to output terminals 1227 of the alarm control module 132 to which may be connected alarm devices, such as horns, lights, bells, etc., which are located externally of the protected of the building.

The relay 212 is energized to close contacts 213 when power at level hi B+ is applied to an operate coil 228 of the relay 212. For a fire alarm condition, hi B+ is extended to the operate coil 228 over a normally non-conducting transistor Q9 which has an emitter connected to hi B+ at terminal 1231 of the module 132, a collector connected to terminal 229 of coil 228 and a base connected over a resistor R52 to the fire signal input at terminal 1239A which is connected to the output of the fire tone decoder module 120 at terminal 1239 (FIG. 14). The other end 229' of coil 228 is connected over a diode D41 to terminal 1239A. Terminal 1239A is normally at a positive potential, maintaining transistor Q9 off. However, the ground level output provided by the fire tone decoder module 120 at terminal 1239 enables transistor Q9 to turn on, extending at hi B+ to the coil 228 and forward biasing diode D41 to energize the coil 228.

The outside alarm devices which may be connected to terminals 1227 are continuously energized whenever a fire signal is provided to the module 132.

For burglary or emergency conditions, an intermittant drive is supplied to operate coil 228 from the time limit cutoff module 134.

Hi B+ extended to the operate coil 228 when the time limit cutoff circuit 205 is enabled, providing hi B+ at terminal 1245. Terminal 1245 is connected to an input of the outside alarm control module at terminal 1246 which is connected over a diode D43 to end 229 of the operate coil 228. The other end 229' of the operate coil 228 is connected over a diode D40 and terminal 1249 to the output of the pulse generation circuit at terminal 1248, which is connected over isolation diode D36 to the output of the pulse generating circuit 206 at point 232.

Accordingly, the relay 212 is pulsed at the duty cycle of the pulse generating circuit 206, which in the illustrative embodiment is one second on and one second off.

DELAYED BURGLARY DIALER MODULE

Figure 19:
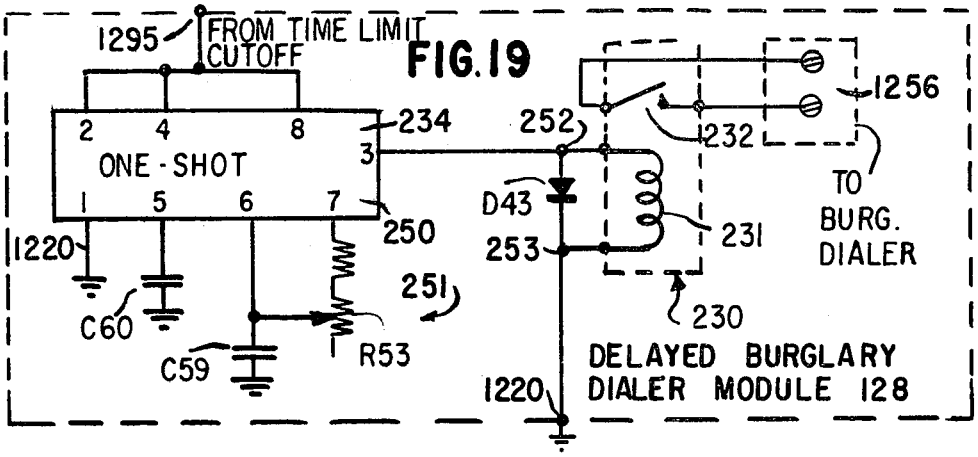
FIG. 19 is a schematic circuit diagram of a delayed burglary dialer actuator module of the receiver.

Referring to FIG. 19, there is shown a schematic circuit diagram of the delayed burglary dialer module 128. The delayed burglary dialer module 128 includes a control relay 230 having normally open contacts 232 connected to terminals 1256 to which may be connected a burglary dialer. The relay 230 has an operate coil 231 which is energizable by a one-shot circuit 234 which in turn is enabled by the output of the time limit cutoff circuit 205 which is extended to the module 128 over terminal 1255 thereof.

The one-shot circuit 234 may comprise a Signetics Type NE-555 timing circuit 250 and an associated timing network 251 comprised of a variable resistor R53 and a capacitor C59 which set the duration for which the one-shot is enabled to provide a hi B+ output at pin 3 supplying an energizing potential at hi B+ to one end 252 of coil 231 which has its other end 253 connected to ground at terminal 1220.

LOOP MONITOR MODULE

Figure 20:
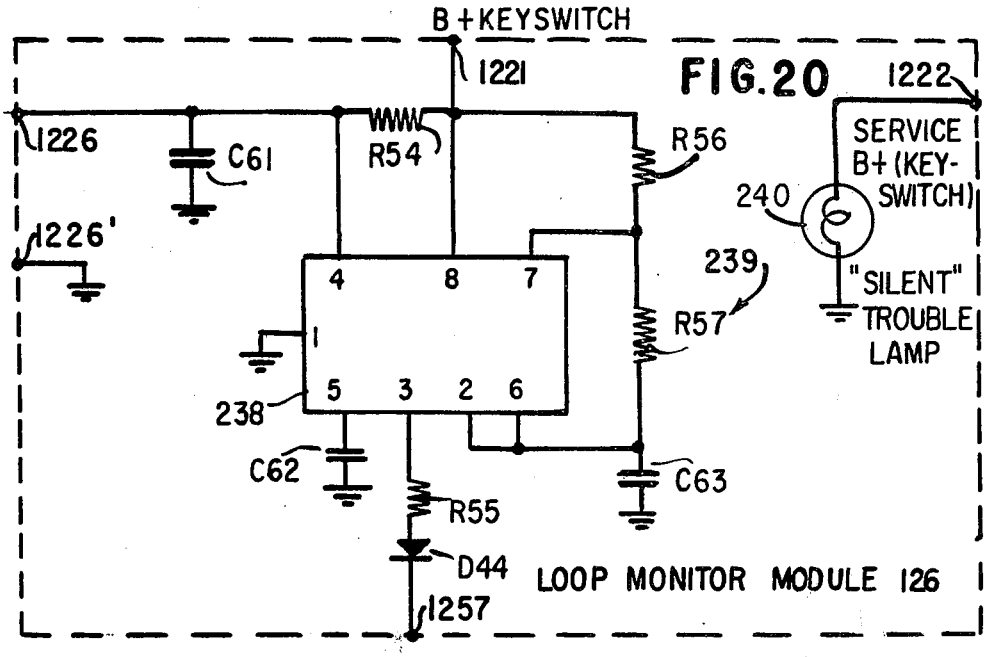
FIG. 20 is a schematic circuit diagram of a loop monitor module of the receiver.

Referring to FIG. 20, there is shown a schematic circuit diagram of the loop monitor module 126. The loop monitor module 126 includes a timing circuit 238, which may be the Signetics Type NE-555 Timing Circuit, connected for operation as an astable multivibrator, which is enabled whenever a discontinuity occurs in the pickup loop 28. The duty cycle of the circuit 238 is determined by a timing network 239 comprised of resistors R56 and R57 and a capacitor C63 which are serially connected between switched B+ at terminal 1221 and ground.

The inputs of the module 126 at terminals 1226 and and 1226' are connected to the trouble signal output terminals 1225 and 1225', respectively of the RF module (FIG. 13.) One input of the module 126 at terminal 1226, is connected to a reset input of the timing circuit 238 at pin 4 which is connected over a resistor R54 to pin 8 of the timing circuit 238 and to switched B+ from the key switch 124 at terminal 1221. The timing circuit 238 has a pin 7 connected to the junction of resistors R56 and R57, and pins 2 and 6 commonly connected to the junction of resistor R57 and capacitor C63.

The output of the circuit 238 at pin 3 is extended over a resistor R55 and a diode D44 to terminal 1257 which is connected to an input of the time limit cutoff module 134 at terminal 1258. Terminal 1258 is connected to the gate of silicon controlled rectifier SCR2 to permit the pulse output of the multivibrator circuit 238 to drive the silicon controlled rectifier SCR2. The timing network 239 has a low time constant to permit the main panel alarm horn 130 to be driven at a fast rate, which may be ten pulses per second for indicating the trouble condition.

The trouble signal is silenced by operating the key switch 124 to the "service position", which causes the hi B+ to be disconnected from terminal 1221 via switch 1242. In addition, when the key switch 124 is operated to the service position, hi B+ is extended to terminal 1222 of the module 26 for energizing the trouble lamp 240 which is connected between terminal 1222 and ground.

POWER SUPPLY MODULE

Figure 21:
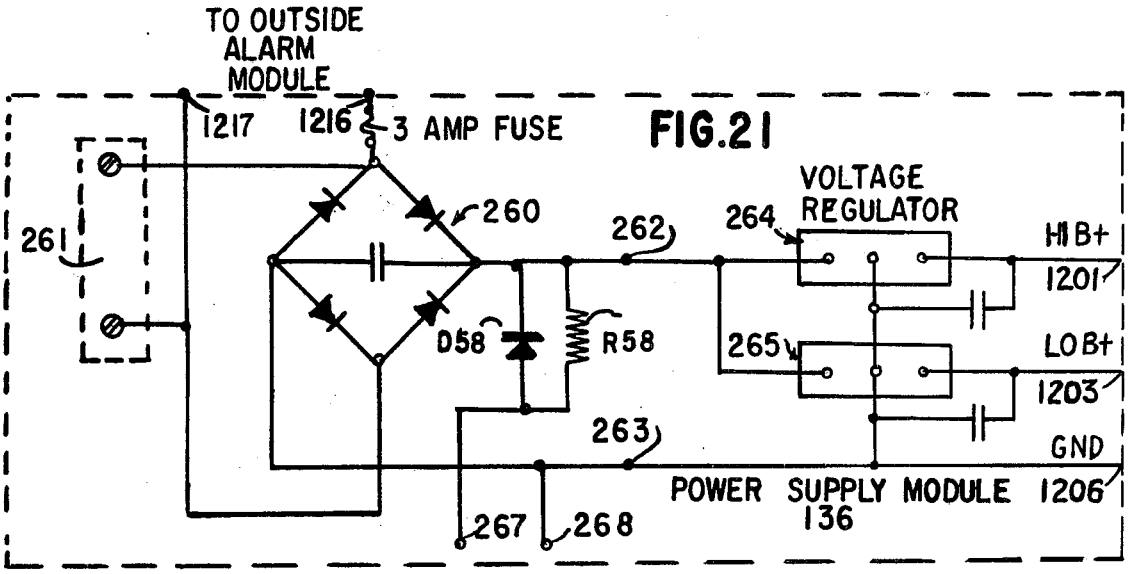
FIG. 21 is a schematic circuit diagram of a power supply module of the receiver.

Referring to FIG. 21, there is shown a schematic circuit diagram of the power supply module 136 which includes a rectifying network 260 connected over terminals 261 to an AC source supplied over a 16 VAC transformer 123 (FIG. 12) connected to terminals 261. Rectified DC provided at the outputs 262 and 263 of the bridge network 260 is extended to a pair of voltage regulator circuits 264 and 265, which may be the Types MC7812 and MC7806, respectively. Regulator circuit 264 provides hi B+, 12 VDC, at terminal 1201, and regulator circuit 265 provides lo B+, +6 VDC, at terminal 1203. Conductor 263 is connected to terminal 1206 provides system ground.

The power supply module 136 may also include a suitable rechargable battery supply (not shown) which is connectable to terminals 267 and 268 to permit the system to be maintained energized in the event of a power failure. Automatic transfer to battery is provided by a diode D58, and battery charging is provided by a resistor R58.

OPERATION OF THE RECEIVER CIRCUIT

The receiver is operable to detect the FSK coded tones generated by the transmitter units such as units 21*a*, 21*b*, and 21*c*, and coupled to the pick-up loop 28. As indicated above, in the event of the detection of fire or smoke in the protected building, one or more of the fire alarm transmitter units 21*c* is enabled to provide signals at 120 KHZ FSK modulated by 350 Hz. Similarly, in the event of operation of the manually operable emergency transmitter unit 21*b*, signals at 120 KHz FSK modulated by 390 Hz will be coupled to the pick-up loop 28. For an unauthorized entry, of the protected building while the system is energized, signals at 120 KHz FSK modulated by 315 Hz are coupled to the pick-up loop 28.

The FSK coded signals coupled to the pick-up loop 28 are received by the input stage 110 of the receiver 20 and, after amplification and limiting, are passed to the demodulator circuit 116 which provides a tone burst output at frequency 315 Hz, 350 Hz or 390 Hz for burglary alarm, fire alarm or emergency alarm indications.

OPERATION OF THE FIRE TONE DETECTION MODULE

Referring to FIG. 14, the fire alarm tone detector module 120 is energized and indicator 173 is lit whenever the system is connected to a 120 VAC source or to battery. The fire alarm test/reset switch 169 is spring biased to the position shown in FIG. 14.

Thus, whenever an audio output tone at frequency 350 Hz is provided at the output 1234 of the RF module 110, such signal, when coupled over capacitor C26 to the input of the tone decoder circuit 164, enables the circuit 164 to provide a ground level at point 168, forward biasing diodes D11 and D20 to provide an energizing path for the master station horn 130 which is energized providing a continuous audible alarm.

The ground level at point 168 also enables relay 170 causing contacts 172 to operate to enable a fire dialer (not shown) to transmit an alarm indication to the fire department.

The ground level at point 168 is further extended over diode D11 to the outside alarm control module 132 (FIG. 18) at terminal 1239*a* which causes transistor Q9 to turn on energizing the relay 212 for energizing the auxilliary equipment connected to terminals 1227.

Since the fire tone decoder 164 latches, when enabled, a fire alarm indication is provided until the decoder circuit 164 is disabled by operating the test/reset switch 169.

OPERATION OF EMERGENCY ALARM DETECTOR MODULE

Referring to FIG. 15, assuming the system is energized and that the key switch 124 is in the position shown in FIG. 12, whenever an audio output at frequency 390 Hz is provided at output 1234 at the RF module 110, such signals coupled over capacitor C29 to the phase lock loop circuit 175 cause the phase lock loop circuit 175 to provide a ground level output at point 176 which enables the phase lock loop circuit 175 to latch over the feedback circuit 178. The ground level at point 176 enables relay 181 which operates to close contacts 183 for energizing auxilliary alarm devices which may be connected terminals 1247. In addition, the ground level at point 176 is extended over resistor R27 to the base of transistor Q7 which extends hi B+ over conductor 185 to terminal 1224 of the time limit cutoff module 134 for energizing the module 134. The ground level at point 176 is also extended over resistor R28 to an input of the time limit cutoff module 134 at terminal 1232 to permit enabling of the master control panel horn 130 and the outside alarm control module 132 for energizing alarm devices connected thereto in a manner to be described hereinafter.

To cancel the emergency alarm, the key switch 124 is operated to the "emergency cancel" position (FIG. 12) which causes hi B+ to be extended to point 186 and thence to pin 1 of the phase lock loop 175 unlatching the phase lock loop circuit 175 and removing ground from point 176. Such action causes relay 181 to restore and transistor Q7 to be cut off thereby removing power from the time limit cutoff module 134 so that the alarm devices, including the master control panel horn 130, are deenergized.

A manual alarm can be provided by operating manual alarm switch 179 which is located on the master control panel 119, causing a ground to be extended to point 186 which enables the phase lock loop circuit 175 to provide a ground lever output at point 176 for effecting operation of the time limit cutoff module 134 and the outside alarm control module 132 to effect the energization of the alarm devices.

BURGLARY TONE DETECTOR MODULE

During periods of the day when occupants of the building require free use of the protected doors and windows without setting off an alarm, the burglary tone detector module 122 may be deenergized by operating the key switch 124 to the "burglary off" position as illustrated in FIG. 12, which cuts off the supply of power at level hi B+ to the burglary tone detector module 122 and the time limit cutoff module 134. For such condition, the receiver 20 does not respond to FSK signals generated by burglary alarm transmitters in response to the opening of a protected door or window, for example.

To energize the burglary tone detector module 122, the key switch 124 is operated by the "burglary on" position which extends hi B+ to the burglary tone detector module 122 and the time limit cutoff module 134. When power is initially applied to the burglary tone detector module 122, silicon controlled rectifier SCR1 is nonconducting. The application of power at level hi B+ to terminal 1225 permits capacitor C46 to charge to a value sufficient to gate silicon controlled rectifier SCR1 into conduction. Capacitor C46 discharges over the gate-cathode circuit of the silicon controlled rectifier SCR1.

When silicon controlled rectifier SCR1 is conducting, the burglary tone detector module 122 is enabled to respond to burglary alarm tone signals detected by the receiver 20. Accordingly, when FSK burglary alarm signals which are detected by the RF module 110 and signals at frequency 315 Hz are thus coupled over capacitor C38 to the burglary tone decoder circuit 188, a ground level is provided at point 190 at the output of the burglary tone decoder 188. Such ground level enables transistor Q8 which turns on, extending the ground level to the trigger input 2 of timing circuit 200 of the entry delay latch circuit 144. The timing circuit 200 is thus enabled to provide a pulse output at terminal 1253 of the burglary tone detector module 122 at level hi B+, the duration of the pulse being determined by the timing network 151. Such output is extended to an input of the time limit cutoff module 134 at terminal 1254 effecting enabling of the time limit cutoff circuit 205 to effect operation of the master panel control horn 130 and the alarm devices controlled by the outside alarm control module 132.

The Day/Night switch 143 is operable to control the duration for which the entry delay circuit 144 is enabled and thus the delay before which the time limit cutoff circuit 205 is enabled. With the Day/Night switch 143 operated to the "day" position, the width of the output pulse provided by the entry delay circuit 144 is determined by the time constant of resistors R37 and R38 and capacitor C50. Resistor R38 is variable to adjust the delay between five and thirty seconds, for example. When switch 143 is set to the "day" position, indicator lamp 197 is energized for indicating that the burglary system is operable in the "day" mode.

When switch 143 is operated to the "night" position, resistor R39 is connected in parallel with resistors R37 and R38 such that the output pulse provided by the entry delay circuit 144 is less than one second, and the time limit cutoff module 134 is enabled almost immediately after an alarm signal at frequency 315 Hz is detected by the burglary tone decoder circuit 188. When switch 143 is in the "night" position, indicator 198 is energized to indicate that the burglary system is operated in the "night" mode.

Digressing, the entry delay latch circuit 144 includes a noise inhibit circuit 148 which prevents false triggering of the timing circuit 200 of the entry delay circuit 144 in the event of power failure and/or restoration of power. Referring to FIG. 16B, there is shown waveforms for signal levels at pins 2 and 4 of the timing circuit 200. As shown in FIG. 16B, when power is initially turned on, the potential at pin 2 rises substantially linearly to approximately $\frac{2}{3}$ hi B+, or 7.6 volts in the present example. When hi B+ reaches approximately 9 volts, the Zener diode D28 fires and the potential at pin 4 rises to approximately one volt.

For normal operation, the timing circuit 200 triggers when the potential at pin 2 drops to $\frac{1}{3}$ hi B+ or approximately four volts. Also, the circuit 200 is enabled to respond to a trigger input at pin 2 whenever the potential at pin 4 is greater than one volt, and is inhibited whenever the potential at pin 4 is less than 0.4 volts.

In the event of a momentary power turnoff, the potential at pins 4 and 2 begins to decrease as shown in FIG. 16B. The circuit 200 is inhibited whenever the potential at pin 4 falls below 0.4 volts whereas pin 2 must drop to below four volts to trigger the circuit 200. As shown in FIG. 16B, the level at pin 4 goes below 0.4 volts before the level at the trigger input pin 2 goes below $\frac{1}{3}$ hi B+. Also, pin 4 will remain below 0.4 volts until after pin 2 has risen above four volts on power restoration. Thus, the timing circuit 200 will not be falsely enabled due to variations in the power supply level.

As indicated above, the burglary system provides an entry delay or an exit delay to permit an authorized person to enter or exit the protected building through a protected door while the burglary tone detector module 122 is energized. For purposes of illustration of exit delay operation, it is assumed that key switch 124 is operated to the "burglary on" position, and that the exit switch 142 is open so that silicon controlled rectifier SCR1 is conducting.

To exit from the protected building, the person leaving first operates the exit switch 142 on the control panel 119, which shunts the silicon controlled rectifier SCR1 which then turns off. Releasing switch 142 removes the base bias from transistor Q8 at point 146 and the system is now in the exit mode. For such condition, indicator 197 (or 198) is driven intermittantly by the pulse output of the pulse generating circuit 208, and the master control panel horn 130 is driven intermittantly at a fast rate providing a subdued "exit" alarm indication.

Referring to FIGS. 16 and 16A, the next door opening causes the output of the burglary tone decoder circuit 188 at point 190 to go to ground and stay there for the duration of the transmitted signal (approximately 1.2 seconds). However, since transistor Q8 is turned off, such ground level is ineffective to enable the entry delay circuit 144. When the door transmitter stops transmitting, (after approximately 1.2 seconds), point 190 goes positive, charging capacitor C45 which triggers silicon controlled rectifier SCR1 into conduction, reestablishing a bias voltage at the base of transistor Q8 and causing indicator 197 (or 198) to be on continuously. The next door opening again causes point 190 to go to ground, instantly enabling transistor Q8 which triggers the entry delay latch circuit 200, which, after a predetermined length of time (5–30 seconds), causes the generation of an alarm indication by enabling the time limit cutoff circuit 134 and outside alarm control module 132 as will be described.

The entry delay circuit 144 permits entry of the protected building while the system is energized without providing an alarm when an occupant of the building opens the protected door to gain admittance of the building. The delay afforded by the entry delay circuit 144 gives the person sufficient time to reach the master control panel and disable the burglary system by operating the key switch 124 to the "burglary off" position.

Upon opening of a protected door while the system is energized to the "burglary on" position, the burglary alarm tone detected by the burglary alarm decoder circuit 188 enables the entry delay circuit 144 over the entry/exit circuit 139, causing the output of the entry delay circuit 144 at terminal 1253 to go to hi B+. Such level is extended to the control circuit 210 of the time limit cutoff module 134 (FIG. 17) to effect a generation of a subdued "entry signal", as will be described hereinafter. Such "entry signal" alerts the person that the burglary system must be disabled or an alarm will be provided.

OPERATION OF TIME LIMIT CUTOFF AND OUTSIDE ALARM CONTROL MODULES

The time limit cutoff module 134, responds to inputs supplied to the emergency tone detecting module 121 and the burglary tone detector module 122 to enable the master control panel horn 130 and the outside alarm control module 132. Referring to FIG. 17, when the emergency tone decoder circuit 175 is enabled to provide a ground level output at terminal 1241 of the emergency tone detector module 121, such output forward biases diode D30 causing the potential at pin 2 of the time limit cutoff circuit 203 to go to ground triggering the time limit cutoff circuit 203 causing point 226 at the output thereof to go from ground to hi B+. The hi B+ potential at point 226 forward biases diode D34 removing ground from point 224 of the timing network 216, enabling pulses from the pulse generator 206 to be extended over resistors R44 and R45 to the gate of the silicon controlled rectifier SCR2 which provides a pulsating drive at a rate of one second on, one second off to the master panel alarm horn 130 (FIG. 14).

In addition, the hi B+ output at point 226 forward biases diode D43 of the outside alarm control module 132 (FIG. 18) supplying hi B+ to terminal 229 of relay 212 which is then driven by output of the pulse generating circuit 206 extended over diode D40 to terminal 229' of the relay 212. The audible emergency alarm is provided until the time limit cutoff circuit 203 times out after approximately four minutes. When the time limit cutoff circuit 203 times out, diode D34 becomes forward biased, grounding point 224 disabling silicon controlled rectifier SCR2, and diode D43 become reverse biased disabling relay 212 such that the master control panel horn 130 and the alarm devices controlled by the outside alarm control module 132 are deenergized.

When the entry delay latch circuit 144 is enabled in response to the detection of a burglary alarm tone by the burglary tone decoder circuit 188, the hi B+ level provided at terminal 1253 of the burglary alarm module 122 reverse biases diode D31 of the time limit cutoff module 134, removing ground from point 224, permitting pulses provided at the output of the pulse generator circuit 206 to be extended over resistor R43 and capacitor C56 to the gate of silicon controlled rectifier SCR2 which is turned on for about 5 milliseconds by the charging of capacitor C56 at a rate determined by the pulse generator. This intermittantly energizes the master alarm control panel horn 130 providing a subdued alarm for the duration of the output pulse provided by the entry delay latch circuit 144. When the entry delay latch circuit 144 times out, the negative going pulse is coupled over capacitor C53 to the trigger input of the time limit cutoff circuit 203 at pin 2 which is then enabled to provide a hi B+ output at point 226 which reverse biases diode D34, removing ground from point 224 enabling outside alarm control relay 212 and master control panel horn 130 to be driven at the rate of the pulse generator 206. When terminal 1254 returns to ground potential, diode D31 is again forward biased grounding point 225.

When the time limit cutoff circuit 203 times out, after four minutes, ground level provided at point 226 forward biases diode D34 to ground point 224 to disable the master alarm control panel horn 130 over silicon controlled rectifier SCR2 and to disable relay 212 of the outside alarm control module 132.

The subdued "entry" signal is provided when the entry delay latch ciruit 144 is enabled by the burglary tone decoder circuit 188 in response to the alarm signal generated as the result of the opening of a protected door. The hi B+ output level provided at terminal 1253 at the output of the entry delay latch circuit 134 reverse biases diode D31 removing ground from point 225 permitting pulses from the pulse generating circuit 206 to be extended over resistor R43 and capacitor C46 6o the gate of the silicon controlled rectifier SCR2 which provides intermittant drive for the master control panel horn at a fast rate producing the subdued "entry" alarm signal for the duration of the pulse output of the entry delay latch circuit 144.

The subdued "exit" signal is provided whenever the exit switch 142 is operated to disable silicon controlled rectifier SCR1. The output of the pulse generating circuit 208 at point 232 is connected over a diode D37 to terminal 1251 which is connected to an output of the burglary module 122 at terminal 1252 thereof. The terminal 1252 is maintained at hi B+ whenever the silicon controlled rectifier SCR1 is conducting, maintaining point 232' at hi B+. Whenever the silicon controlled rectifier SCR1 is cutoff in response to operation of the exit switch 142, point 232' follows the output of the pulse generating circit 208, extending a pulsating drive signal to terminal 1252 of the burglary module 122 for driving intermittantly the day lamp 197 (or night lamp 198) to indicate that the burglary system is operating in the "exit" mode. In addition, when diode D37 becomes forward biased, the pulse output of the pulse generating circuit 206 is coupled over a capacitor C55 to the gate of the silicon controlled rectifier SCR2 to supply intermittant drive to the master control panel horn 130. The short pulses coupled to the gate of the silicon controlled rectifier SCR2 provide the subdued "exit" signal for indicating that the burglary system is operating in the "exit" mode.

For a fire alarm condition, the master control panel horn 130 is driven directly by the fire tone detector module 120 (FIG. 14) as indicated above. In addition, the ground level output provided at point 168 of the fire tone decoder circuit 175 enables transistor Q9 to turn on, effecting continuous energization of the control relay 212 for operating the auxilliary apparatus connected to terminals 1227 of the outside alarm control module 132. It is pointed out that the fire alarm supercedes the emergency or burglary alarms, so that in the event that both the fire alarm module 120 and the burglary alarm module 122, for example, are enabled simultaneously, the master control panel horn 130 and the auxilliary alarm devices are controlled by the outside alarm control module 132 are continuously energized providing a continuous audible alarm.

OPERATION OF DELAYED BURGLARY DIALER MODULE

Referring to FIG. 19, the one-shot circuit 234 of the delayed burglary dialer module 123 is enabled by the application of hi B+ to terminal 1295 from the output of the time limit cutoff circuit 203 at terminal 1245. When enabled, the one-shot circuit 234 after a time determined by capacitor C59 and resistor R53 supplies an energizing signal at level hi B+ to relay 230 which then operates to close contacts 232 for energizing a burglary dialer (not shown) connectable to terminals 1256 of the module 128 to transmit the burglary indication to the local police department. Should the burglary alarm condition be aborted by operating key switch 124 to the "burglary off" position, the delayed burglary dialer module 128 will be deenergized preventing transmission of the alarm condition.

OPERATION OF LOOP MONITOR MODULE

Referring to FIG. 20, the inhibit input at pin 4 of the timing circuit 238 of the loop monitor module 126 is maintained at a potential below 0.4 volts whenever the pickup loop 28 is continuous. Terminal 1226, which is connected to the inhibit input at pin 4 of the timing circuit 238, is also connected to the trouble output at terminal 1225 (FIG. 13) of the RF module which is referenced to ground over resistor R11 at terminal 112 over the loop 28, and over resistor R10 at terminal 111. Accordingly, when the loop 28 is continuous, the charge on capacitor C61 is maintained at a value less than 0.4 volts. In the event the pickup loop 28 is broken, capacitor C61 charges from hi B+, over resistor R54, which is connected to hi B+ at terminal 1221 of the module 126, causing the potential at the inhibit input pin 4 of the timing circuit 238 to increase. When the potential at pin 4 exceeds 1 volt, the multivibrator circuit 238 is enabled, providing output pulses at a rate of ten pulses per second which pulses are extended over resistor R55 and diode D44 to the gate of silicon controlled rectifier SCR2 (FIG. 17) at terminal 1258 of the time limit cutoff module 134, providing an intermittant drive for the silicon controlled rectifier SCR2 for driving the master control panel horn 130 at the rate of ten pulses per second for indicating the trouble condition.

When the loop monitor module 126 is disabled by operating the key switch 124 to the "service" position, the "trouble" lamp 240 is energized at the master control panel 119 to indicate that the system is operating in the "service" mode.

BATTERY CHARGING CIRCUIT

In the embodiments described hereinabove, the battery powered transmitter units, such as transmitter units 21, may be energized by a nickel cadmium battery. It is pointed out that other types of batteries, such as lithium batteries may be used to power the transmitter units. Even though the security alarm system of the present invention minimizes power drain on the batteries which power the transmitter units, it is apparent that the batteries have a limited lifetime.

Figure 22:
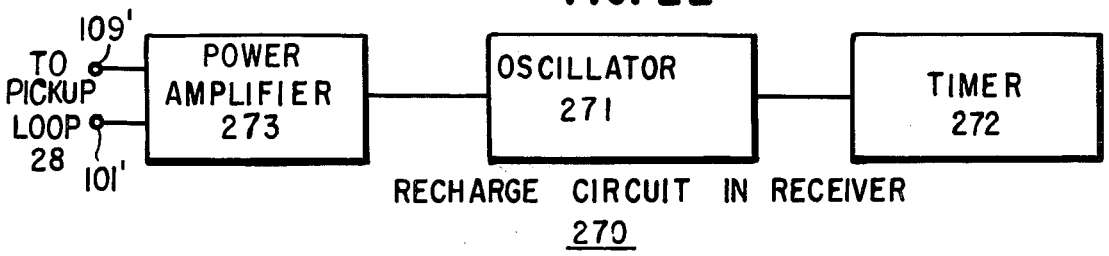
FIG. 22 is a block diagram of the transmitter portion of a battery charger circuit; and, FIGS. 23 and 24 show receiver circuit portions of battery charging circuits for use with the transmitter circuits shown in FIGS. 8 and 9.

Accordingly, to increase the effectiveness of the security alarm system wherein rechargeable batteries, such as nickel cadmium batteries, are used, the system may include a battery charging circuit including a power signal transmitter 270 shown in block diagram form in FIG. 22, which is located in the receiver 20 and which periodically generates power signals which are coupled to the pickup loop 28. Each transmitter unit, such as transmitter unit **21*a* includes a power signal receiver, such as receiver 280 shown in FIG. 23**, which receives the power signals and responsively supplies charging current to the battery.

Referring to FIG. 22, the power signal generator 270 includes an oscillator circuit 270 which is periodically enabled by a timer circuit 272 to generate signals at a predetermined frequency which signals are extended over a power amplifier 273 to the pick-up loop 28. The frequency output of the oscillator 271 may, for example, be 10.8 KHz to minimize interference with alarm signals which are also coupled to the pick-up loop 28. The timer circuit 272, the oscillator circuit 271 and the power amplifier circuit 273 may be conventional circuits known in the art.

Figure 23:
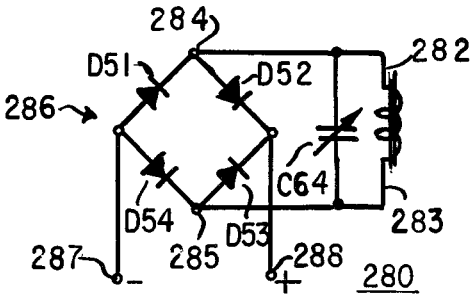

Referring to FIG. 23, the power signal receiver 280 comprises a tuned circuit 281, including coil 282, and a capacitor C64 which are connected in parallel across inputs 284 and 285 of a full wave bridge network 286 comprised of diodes D51–D54. The output of the bridge network 286 at terminals 287 and 288 is connectable to respective positive and negative terminals of the battery 92 shown in FIG. 8 or 9, for example.

The capacitor C64 is variable to tune the circuit 281 for a frequency of 10.8 KHz. In response to power signals transmitted over the pickup loop 28, an AC voltage on the order of 3.8 volts peak-to-peak appears across the tuned circuit 281 providing a DC charging current on the order of 43 microamps to be supplied to the battery 92.

Figure 24:
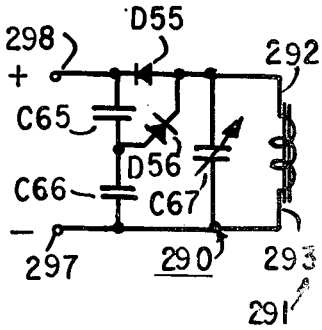

Referring to FIG. 24, there is shown an alternative embodiment for power signal receiver circuit 290 which includes a tuned circuit 291, which is similar to tuned circuit 281 of FIG. 23, and a voltage doubler circuit 296 including capacitors C65 and C66 and diodes D55 and D56. The tuned circuit 291 includes a coil 292 wound on a ferrite stick 293 and a tuning capacitor C67 connected in parallel with the coil 292. One end 294 of the coil 292 is connected over diode D55 to an output terminal 298 of the receiver circuit 290, which is connectable to the positive terminal of the battery 92, and the other end 295 of the coil is connected to an output terminal 297, which is connectable to the negative terminal of the battery 92. Voltage doubler capacitors C55 and C56 are connected in parallel across output terminals 298 and 297. Diode D56 is connected between the junction of capacitors C55 and C56 at point 279 and end 294 of coil 292.

In operation, for positive swings of the power signals, received by the tuned circuit 291, capacitors C65 and C66 are charged over diode D55. When the power input signal swings negative, diode D56 becomes forward biased, permitting capacitors C55 and C56 to discharge through the battery 92 supplying charging current to the battery 92.

FURTHER EMBODIMENTS

The security alarm system has been described by way of an exemplary embodiment wherein the transmitter units generate FSK signals which are received and decoded by phase lock loop circuits of the receiver. However, it is pointed out that other types of signalling, such as amplitude or frequency modulation, may be employed by the transmitter units, and in such embodiments, different frequency detection and control techniques would be used as will be apparent to those skilled in the art. For example, where amplitude modulation is employed, the receiver input section would include a suitable AM detector, and the output control functions, including the detection of the individual tone signals which represent burglary, fire and emergency alarm conditions, could be accomplished using tuned circuits or tuned reed relays, for example.

I claim:

1. In a security alarm system for a protected area, communicating apparatus comprising a plurality of transmitter units in said protected area, each of said transmitter units including condition sensing means and a transmitter circuit controlled by its associated sensing means to provide an information signal in response to a change in a condition as sensed by its associated sensing means, receiver means at said protected area, and signal coupling means including conductor means extending around the periphery of the area protected in a loop and having first and second ends connected to respective first and second inputs of said receiver means, said conductor means defining a controlled area of influence in which inductive signal coupling is provided between an output stage of each transmitter circuit located within said controlled area of influence and said conductor means to permit the information signals provided by transmitter circuits located within said controlled area of influence to be inductively coupled over said conductor means to said receiver means connected thereto and to limit the response of said receiver means to information signals provided by transmitter circuits located within said controlled area of influence, detecting means in said receiver means for detecting information signals coupled to said receiver means over said conductor means, and means controlled by said detecting means to provide an indication of the change in a monitored condition.

2. A security alarm system as set forth in claim 1 wherein at least one of said transmitter circuits is operable to provide information signals at a first frequency in response to a change in a first condition, and a second one of said transmitter circuits is operable to provide information signals at a second frequency in response to a change in a second condition, and in which said detecting means includes a first frequency detecting circuit operable to provide a first output signal in response to receipt of information signals at said first frequency and a second frequency detecting circuit operable to provide a second output signal in response to receipt of information signals at said second frequency.

3. A security alarm system as set forth in claim 2 wherein said means controlled by said detector means includes an alarm horn means, and alarm control means responsive to said first and second output signals to effect energization of said alarm horn means to provide respective first and second alarms.

4. A security alarm system as set forth in claim 3 wherein said alarm horn means is continuously energized responsive to one of said output signals to provide said first alarm, and wherein said alarm control means includes a first means responsive to the other one of said output signals to effect intermittantly energization of said alarm horn means to provide said second alarm.

5. A security system as set forth in claim 4 wherein said receiver means includes loop monitoring means including signal generating means enabled in response to an open-circuit condition for said conductor means to provide an output signal to control said first means to provide a further alarm.

6. A security alarm system as set forth in claim 1 wherein at least one of said transmitter circuit is operable to provide an alarm signal in response to each opening of a protected door of a building, said detecting means in said receiver means being responsive to each alarm signal provided by said one transmitter circuit to provide a control signal for the duration of the alarm signal, said means controlled by said detecting means including alarm means normally operable to respond to each control signal provided by said detecting means to effect the generation of an alarm, exit delay means, means for causing said exit delay means to prevent said alarm means from responding to a first control signal provided in response to a first opening of said door, thereby permitting one opening and closing of said protected door without providing said alarm, said exit delay means being controlled by said first control signal to permit said alarm means to respond to a second control signal provided in response to the next opening of said door.

7. In a security alarm system for a building, an alarm apparatus for providing a first alarm for indicating unauthorized entry of the building and a second alarm for indicating the presence of fire or smoke within the building, said alarm apparatus comprising a plurality of transmitter units, a first one of said transmitter units being associated with a protected entrance of the building and having a first transmitter circuit and entry switch means responsive to an unauthorized entry of the building to enable said first transmitter circuit to provide alarm signals at a first frequency, and a second one of said transmitter units having a second transmitter circuit and sensor means responsive to the presence of fire or smoke within the building to enable said second transmitter circuit to provide alarm signals at a second frequency, receiver means in said building, and signal coupling means including conductor means extending around the periphery of said building in a loop and having first and second ends connected to respective first and second inputs of said receiver means, said conductor means defining a controlled area of influence in which inductive signal controlling is provided between an output stage of each transmitter circuit located within said controllled area of influence and said conductor means to permit the alarm signals provided by said first and second transmitter circuits to be inductively coupled over said conductor means to said receiver means connected thereto and to limit the response of said receiver means to alarm signals provided by transmitter circuits located within said controlled area of influence, said receiver means including detector means for detecting said alarm signals coupled to said receiver means over said conductor means, and operable to provide a first output signal in response to said alarm signals at said first frequency to effect the generation of said first alarm, and to provide a second output signal in response to said alarm signals at said second frequency to effect the generation of said second alarm.

8. A security alarm system as set forth in claim 7 which includes a further alarm transmitter unit having third transmitter circuit manually energizable to provide alarm signals at a third frequency, said detector means being responsive to said alarm signals at a third frequency to provide a third output signal for effecting the generation of a third alarm indication.

9. A security alarm system as set forth in claim 8 wherein said detector means includes a frequency detector circuit enabled to provide said third output signal, said frequency detector circuit including feedback means having switch means for extending said third output signal to an input of said frequency detector circuit to maintain said frequency detector circuit enabled in a latched condition whenever said third output signal is provided, said switch means being operable to permit disabling of said frequency detector circuit.

10. A security alarm system as set forth in claim 7 wherein said receiver means includes alarm means operable to provide said alarm indications, said detector means including a first frequency detector circuit enabled to provide said first output signal in response to the detection of said alarm signals by at said first frequency said detector means and alarm control means responsive to said first output signal to enable said alarm means to provide said first alarm, and a second frequency detector circuit enabled to provide said second output signal in response to the detection of said alarm signals at said second frequency by said detector means for enabling said alarm means to provide said second alarm.

11. A security alarm system as set forth in claim 10 wherein said second frequency detector circuit includes feedback means for coupling said second output signal to an input of said second frequency detector circuit to maintain said second frequency detector circuit enabled in a latched condition whenever said second output signal is provided, said feedback means including switch means operable to disable said second frequency detector circuit.

12. A security alarm system as set forth in claim 10 wherein said receiver means includes switch means for enabling said first frequency detector circuit to be operable in a first mode to provide said first output signal when said alarm signals at said first frequency are detected by said detector means, and to be operable in a second mode to be inhibited from providing said first output signal when said alarm signals at said first frequency are detected by said detector means.

13. A security alarm system as set forth in claim 12 wherein said alarm control means includes entry circuit means having entry delay means operable to delay enabling of said alarm means for a predetermined time to thereby permit entry of the building without providing said first alarm while said first frequency detector circuit is operable in said first mode.

14. A security alarm system as set forth in claim 12 wherein said alarm control means includes exit circuit means normally enabled when said first frequency detector circuit is operable in said first mode to permit said alarm means to respond to each of the output signals provided by said first frequency detector circuit, and means for disabling said exit circuit means to prevent said alarm means from responding to an output signal provided in response to a first opening of a protected door to permit exit of the building through a protected entrance without providing said first alarm, said exit circuit means being reenabled when said output signal terminates to permit said alarm means to respond to an output signal provided by said first detector circuit in response to the next opening of said protected door.

15. In a security alarm system for building, an alarm apparatus for providing a first alarm for indicating unauthorized entry of the building and a second alarm for indicating the presence of smoke within the building, said alarm apparatus comprising a plurality of transmitter units, a first one of said transmitter units being associated with a protected entrance of the building and having a first transmitter circuit, power circuit means for supplying DC power from a battery to said first transmitter circuit, and entry switch means responsive to an unauthorized entry of the building to enable said first transmitter circuit to provide alarm signals at a first frequency, and a second one of said transmitter units having a second transmitter circuit, power circuit means for supplying DC power from a battery to said second transmitter circuit and sensor means responsive to the presence of smoke within the building to enable said second transmitter circuit to provide alarm signals at a second frequency, receiver means, and signal coupling means including conductor means extending around the periphery of said building in a loop and having first and second ends connected to responsive first and second inputs of said receiver means, said conductor means defining a controlled area of influence in which inductive signal coupling is provided between an output stage of each transmitter circuit located within said controlled area of influence and said conductor means to permit the alarm signals provided by said first and second transmitter circuits to be inductively coupled over said conductor means to said receiver means connected thereto, said receiver means including detector means for detecting said alarm signals coupled to said receiver means over said conductor means, and operable to provide a first output signal to response to alarm signals at said first frequency to effect the generation of said first alarm, and to provide a second output signal in response to alarm signals at said second frequency to effect the generation of said second alarm, said receiver means further including signal generating means for periodically generating power signals at a predetermined frequency and means for coupling said power signals to said conductor means to permit said power signals to be inductively coupled to the output state of each of said transmitter units, the power circuit means of at least certain ones of said transmitter units including battery charging circuit means having means for detecting said power signals and circuit means responsive to the detected power signals for supplying charging current to the battery.

16. In a security alarm system for a protected area, communicating apparatus comprising a plurality of transmitter units in said protected area each of said transmitter units including condition sensing means and a transmitter circuit having alarm signal generating means and power circuit means for supplying DC power from a battery to the associated alarm signal generating means, each alarm signal generating means being controlled by its associated sensing means to provide an alarm signal in response to a change in a condition as sensed by its associated sensing means, receiver means, and signal coupling means including conductor means extending around the periphery of the area protected in a loop and having first and second ends connected to respective first and second inputs of said receiver means, said conductor means defining a controlled area of influence in which inductive signal coupling is provided between an output stage of each transmitter circuit located within said controlled area of influence and said conductor means to permit the alarm signals provided by said transmitter circuits to be inductively coupled over said conductor means to said receiver means connected thereto, detecting means in said receiver means for detecting alarm signals coupled to said receiver means over said conductor means, means controlled by said detecting means to provide an indication of the change in a monitored condition, said receiver means further including means for generating power signals at a preselected frequency and means for applying said power signals to said conductor means, at least one of said power circuit means including battery charging circuit means responsive to power signals applied to said conductor means by said receiver means to provide charging current for the battery.

* * * * *

UNITED STATES PATENT AND TRADEMARK OFFICE

CERTIFICATE OF CORRECTION

PATENT NO. : 4,148,019

DATED : April 3, 1979

INVENTOR(S) : John E. Durkee

It is certified that error appears in the above-identified patent and that said Letters Patent are hereby corrected as shown below:

Column 3, line 29, "pulse" should be -- plus --;
Column 36, line 38, "circuit" should be -- circuits --;
Column 37, line 10, "controlling" should be -- coupling --;
Column 37, line 12, "controllled" should be -- controlled --;
Column 37, line 29, after "unit" insert -- located within said controlled area of influence --;
Column 37, line 30, before "third" insert -- a --;
Column 37, line 50, cancel "by";
Column 37, line 51, before "said" insert -- by --;
Column 37, line 51, insert a comma before "and";
Column 38, line 32, after "for" insert -- a --;
Column 38, line 53, "responsive" should be -- respective --;
Column 39, line 7, "state" should be -- stage --;
Column 39, line 15, insert a comma after "area".

Signed and Sealed this

*Eighteenth* Day of *September 1979*

[SEAL]

*Attest:*

*Attesting Officer*

LUTRELLE F. PARKER

*Acting Commissioner of Patents and Trademarks*